US009511264B2

(12) United States Patent
Sullivan et al.

(10) Patent No.: US 9,511,264 B2
(45) **Date of Patent: *Dec. 6, 2016**

(54) MULTILAYER CORE GOLF BALL HAVING HARDNESS GRADIENT WITHIN AND BETWEEN EACH CORE LAYER

(71) Applicant: Acushnet Company, Fairhaven, MA (US)

(72) Inventors: Michael J. Sullivan, Barrington, RI (US); Brian Comeau, Berkley, MA (US); Douglas S. Goguen, New Bedford, MA (US); David A. Bulpett, Boston, MA (US)

(73) Assignee: Acushnet Company, Fairhaven, MA (US)

( * ) Notice: Subject to any disclaimer, the term of this patent is extended or adjusted under 35 U.S.C. 154(b) by 315 days.

This patent is subject to a terminal disclaimer.

(21) Appl. No.: 13/644,074

(22) Filed: Oct. 3, 2012

(65) Prior Publication Data

US 2013/0029789 A1 Jan. 31, 2013

Related U.S. Application Data

(63) Continuation-in-part of application No. 12/635,025, filed on Dec. 10, 2009, now Pat. No. 8,313,394, and a continuation-in-part of application No. 12/635,064, filed on Dec. 10, 2009, now Pat. No. 8,317,637, and a continuation-in-part of application No. 12/635,124, filed on Dec. 10, 2009, now Pat. No. 8,313,395, and a continuation-in-part of application No. 12/635,143, (Continued)

(51) Int. Cl.
*A63B 37/00* (2006.01)
*A63B 37/04* (2006.01)

(52) U.S. Cl.
CPC ..... *A63B 37/0062* (2013.01); *A63B 37/0063* (2013.01); *A63B 37/0092* (2013.01); *A63B 37/0064* (2013.01); *A63B 37/0075* (2013.01); *A63B 37/0076* (2013.01); *A63B 37/0096* (2013.01)

(58) Field of Classification Search
CPC ..... A63B 37/004
USPC ..... 473/374–376, 377
See application file for complete search history.

(56) References Cited

U.S. PATENT DOCUMENTS

| | | | |
|---|---|---|---|
| 3,784,209 | A | 1/1974 | Berman |
| 3,986,802 | A | 10/1976 | Isom |
| 4,570,937 | A | 2/1986 | Yamada |
| 4,650,193 | A | 3/1987 | Molitor et al. |
| 5,033,748 | A | 7/1991 | Ebisuno |
| 5,184,828 | A | 2/1993 | Kim et al. |
| 5,334,673 | A | 8/1994 | Wu |
| 5,484,870 | A | 1/1996 | Wu |
| 5,516,110 | A | 5/1996 | Yabuki et al. |
| 5,697,856 | A | 12/1997 | Moriyama et al. |
| 5,733,206 | A | 3/1998 | Nesbitt et al. |
| 5,782,707 | A | 7/1998 | Yamagishi et al. |

(Continued)

OTHER PUBLICATIONS

Rick White, Shore Durometer Conversion Chart, uploaded Nov. 14, 2014, Thermal Tech Equipment, 1 page.*

*Primary Examiner* — Gene Kim
*Assistant Examiner* — Matthew B Stanczak
(74) *Attorney, Agent, or Firm* — Margaret C. Barker

(57) ABSTRACT

The present invention is directed to an improved multi-layered core golf ball wherein each core layer comprises its own specific hardness gradient (positive, negative or a combination) in addition to an overall specific hardness gradient from one core layer to the next.

6 Claims, 13 Drawing Sheets

Related U.S. Application Data filed on Dec. 10, 2009, now Pat. No. 8,298,097, and a continuation-in-part of application No. 12/635,201, filed on Dec. 10, 2009, now Pat. No. 8,298,098, and a continuation-in-part of application No. 12/469,312, filed on May 20, 2009, now Pat. No. 7,998,002, which is a continuation-in-part of application No. 12/469,258, filed on May 20, 2009, now Pat. No. 7,963,863, which is a continuation-in-part of application No. 11/829,461, filed on Jul. 27, 2007, now Pat. No. 7,537,530, which is a continuation-in-part of application No. 11/772,903, filed on Jul. 3, 2007, now Pat. No. 7,537,529, which is a continuation-in-part of application No. 12/492,514, filed on Jun. 26, 2009, now Pat. No. 8,025,594, and a continuation-in-part of application No. 12/558,732, filed on Sep. 14, 2009, now Pat. No. 7,857,715, which is a continuation of application No. 12/186,877, filed on Aug. 6, 2008, now Pat. No. 7,803,069, which is a continuation-in-part of application No. 12/558,726, filed on Sep. 14, 2009.

(56) References Cited

U.S. PATENT DOCUMENTS

| | | | | |
|---|---|---|---|---|
| 5,803,834 | A | 9/1998 | Yamagishi et al. | |
| 5,957,784 | A | 9/1999 | Asakura et al. | |
| 5,976,443 | A | 11/1999 | Nesbitt et al. | |
| 6,113,831 | A * | 9/2000 | Nesbitt et al. | 264/250 |
| 6,319,154 | B1 | 11/2001 | Yoshida et al. | |
| 6,432,342 | B1 * | 8/2002 | Nesbitt et al. | 264/250 |
| 6,494,793 | B1 | 12/2002 | Ohama | |
| 6,494,794 | B1 | 12/2002 | Ohama | |
| 6,506,851 | B2 | 1/2003 | Wu | |
| 6,520,872 | B2 | 2/2003 | Endo et al. | |
| 6,533,683 | B2 | 3/2003 | Watanabe | |
| 6,537,158 | B2 | 3/2003 | Watanabe | |
| 6,632,147 | B2 | 10/2003 | Cavallaro et al. | |
| 6,659,888 | B2 | 12/2003 | Endo et al. | |
| 6,679,791 | B2 | 1/2004 | Watanabe | |
| 6,689,860 | B2 | 2/2004 | Iwami | |
| 6,739,986 | B2 | 5/2004 | Higuchi et al. | |
| 6,786,838 | B2 | 9/2004 | Sullivan et al. | |
| 6,805,644 | B1 | 10/2004 | Moriyama et al. | |
| 6,815,521 | B2 | 11/2004 | Iwami | |
| 6,835,794 | B2 | 12/2004 | Wu et al. | |
| 6,837,803 | B2 | 1/2005 | Nanba et al. | |
| 6,921,345 | B2 | 7/2005 | Higuchi et al. | |
| 6,932,720 | B2 | 8/2005 | Hogge et al. | |
| 7,004,854 | B2 | 2/2006 | Hogge et al. | |
| 7,153,224 | B2 | 12/2006 | Higuchi et al. | |
| 7,182,702 | B2 | 2/2007 | Hogge et al. | |
| 7,429,221 | B1 * | 9/2008 | Bulpett | A63B 37/0003 473/376 |
| 8,021,248 | B2 | 9/2011 | Sullivan et al. | |
| 8,313,394 | B2 * | 11/2012 | Sullivan et al. | 473/373 |
| 8,529,374 | B2 * | 9/2013 | Sullivan et al. | 473/377 |
| 8,784,235 | B2 * | 7/2014 | Sullivan et al. | 473/372 |
| 2002/0045497 | A1 * | 4/2002 | Watanabe | 473/371 |
| 2005/0176523 | A1 | 8/2005 | Boehm et al. | |
| 2006/0047081 | A1 * | 3/2006 | Ladd et al. | 525/261 |
| 2007/0129172 | A1 * | 6/2007 | Cavallaro | 473/371 |
| 2007/0270244 | A1 * | 11/2007 | Sullivan et al. | 473/377 |
| 2008/0153629 | A1 * | 6/2008 | Sullivan | 473/377 |
| 2008/0161130 | A1 * | 7/2008 | Sullivan et al. | 473/374 |
| 2008/0161132 | A1 * | 7/2008 | Sullivan et al. | 473/376 |
| 2008/0161133 | A1 * | 7/2008 | Sullivan et al. | 473/376 |
| 2008/0194358 | A1 * | 8/2008 | Higuchi | 473/373 |
| 2008/0274829 | A1 * | 11/2008 | Comeau et al. | 473/374 |
| 2010/0087276 | A1 | 4/2010 | Sullivan et al. | |
| 2010/0093467 | A1 | 4/2010 | Sullivan et al. | |
| 2010/0160083 | A1 | 6/2010 | Sullivan et al. | |
| 2010/0160084 | A1 | 6/2010 | Sullivan et al. | |
| 2010/0160085 | A1 * | 6/2010 | Sullivan et al. | 473/374 |
| 2010/0160086 | A1 | 6/2010 | Sullivan et al. | |
| 2010/0227707 | A1 | 9/2010 | Sullivan et al. | |
| 2010/0273577 | A1 * | 10/2010 | Sullivan et al. | 473/374 |

* cited by examiner

MULTILAYER CORE GOLF BALL HAVING HARDNESS GRADIENT WITHIN AND BETWEEN EACH CORE LAYER

CROSS REFERENCE TO RELATED APPLICATIONS

This application is a continuation-in part of each of the following: U.S. patent application Ser. No. 12/635,025 ("'025"), filed Dec. 10, 2009; U.S. patent application Ser. No. 12/635,064 ("'064"), filed Dec. 10, 2009; U.S. patent application Ser. No. 12/635,124 ("'124"), filed Dec. 10, 2009; U.S. patent application Ser. No. 12/635,143 ("'143"), filed Dec. 10, 2009; and U.S. patent application Ser. No. 12/635,201 ("'201"), filed Dec. 10, 2009. And these parent applications are in turn related to other applications as follows. '025 is a continuation-in-part of U.S. patent application Ser. No. 12/469,312, filed May 20, 2009, which is a continuation-in-part of U.S. patent application Ser. No. 12/469,258, also filed May 20, 2009, which is a continuation-in-part of U.S. patent application Ser. No. 11/829,461, filed Jul. 27, 2007, now U.S. Pat. No. 7,537,530, which is a continuation-in-part of U.S. patent application Ser. No. 11/772,903, filed Jul. 3, 2007, now U.S. Pat. No. 7,537,529; further a continuation-in-part of U.S. patent application Ser. No. 12/492,514, filed Jun. 26, 2009; still further a continuation-in-part of U.S. patent application Ser. Nos. 12/558,732 and 12/558,726, filed Sep. 14, 2009, which are continuations of U.S. patent application Ser. No. 12/186,877, filed Aug. 6, 2008, which is a continuation of U.S. Pat. No. 7,410,429, filed Aug. 1, 2007, which is a continuation-in-part of U.S. Pat. No. 7,537,530, filed Jul. 27, 2007, which is a continuation-in-part of U.S. Pat. No. 7,537,529, filed Jul. 3, 2007. '064 is a continuation-in-part of '025, which is related to other applications as set forth above. '124 is a continuation-in-part of '064, which is related to other applications as set forth above. '143 is a continuation-in-part of '025, which is related to other applications as set forth above. '201 is a continuation-in-part of '143, which is related to other applications as set forth above. The entire disclosure of each of these references is hereby incorporated herein by reference.

FIELD OF THE INVENTION

The present invention generally relates to golf balls and more particularly is directed to golf balls having multi-layered cores comprising a hardness gradient within each core layer as well as from core layer to core layer.

BACKGROUND OF THE INVENTION

Golf balls have conventionally been constructed as either two piece balls or three piece balls. The choice of construction between two and three piece affects the playing characteristics of the golf balls. The differences in playing characteristics resulting from these different types of constructions can be quite significant.

Three piece golf balls, which are also known as wound balls, are typically constructed from a liquid or solid center surrounded by tensioned elastomeric material. Wound balls are generally thought of as performance golf balls and have a good resiliency, spin characteristics and feel when struck by a golf club. However, wound balls are generally difficult to manufacture when compared to solid golf balls.

Two piece balls, which are also known as solid core golf balls, include a single, solid core and a cover surrounding the core. The single solid core is typically constructed of a crosslinked rubber, which is encased by a cover material. For example, the solid core can be made of polybutadiene which is chemically crosslinked with zinc diacrylate or other comparable crosslinking agents. The cover protects the solid core and is typically a tough, cut-proof material such as SURLYN®, which is a trademark for an ionomer resin produced by DuPont. This combination of solid core and cover materials provides a golf ball that is virtually indestructible by golfers. Typical materials used in these two piece golf balls have a flexural modulus of greater than about 40,000 psi. In addition, this combination of solid core and cover produces a golf ball having a high initial velocity, which results in improved distance. Therefore, two piece golf balls are popular with recreational golfers because these balls provide high durability and maximum distance.

The stiffness and rigidity that provide the durability and improved distance, however, also produce a relatively low spin rate in these two piece golf balls. Low spin rates make golf balls difficult to control, especially on shorter shots such as approach shots to greens. Higher spin rates, although allowing a more skilled player to maximize control of the golf ball on the short approach shots, adversely affect driving distance for less skilled players. For example, slicing and hooking the ball are constant obstacles for the lower skill level players. Slicing and hooking result when an unintentional side spin is imparted on the ball as a result of not striking the ball squarely with the face of the golf club. In addition to limiting the distance that the golf ball will travel, unintentional side spin reduces a player's control over the ball. Lowering the spin rate of the golf ball reduces the adverse effects of unintentional side spin. Hence, recreational players typically prefer golf balls that exhibit low spin rate.

Various approaches have been taken to strike a balance between the spin rate and the playing characteristics of golf balls. For example, additional core layers, such as intermediate core and cover layers are added to the solid core golf balls in an attempt to improve the playing characteristics of the ball. These multi-layer solid core balls include multi-layer core constructions, multi-layer cover constructions and combinations thereof. In a golf ball with a multi-layer core, the principal source of resiliency is the multi-layer core. In a golf ball with a multi-layer cover and single-layer core, the principal source of resiliency is the single-layer core.

In addition, varying the materials, density or specific gravity among the multiple layers of the golf ball controls the spin rate. In general, the total weight of a golf ball has to conform to weight limits set by the United States Golf Association ("USGA"). Although the total weight of the golf ball is controlled, the distribution of weight within the ball can vary. Redistributing the weight or mass of the golf ball either toward the center of the ball or toward the outer surface of the ball changes the dynamic characteristics of the ball at impact and in flight. Specifically, if the density is shifted or redistributed toward the center of the ball, the moment of inertia of the golf ball is reduced, and the initial spin rate of the ball as it leaves the golf club increases as a result of the higher resistance from the golf ball's moment of inertia. Conversely, if the density is shifted or redistributed toward the outer surface of the ball, the moment of inertia is increased, and the initial spin rate of the ball as it leaves the golf club would decrease as a result of the higher resistance from the golf ball's moment of inertia.

The redistribution of weight within the golf ball is typically accomplished by adding fillers to one or more of the core or cover layers of the golf ball. Conventional fillers include the high specific gravity fillers, such as metal or metal alloy powders, metal oxide, metal stearates, particulates, and carbonaceous materials and low specific gravity fillers, such as hollow spheres, microspheres and foamed particles. However, the addition of fillers may adversely interfere with the resiliency of the polymers used in golf balls and thereby the coefficient of restitution of the golf balls.

Prior art golf balls have multiple core layers to provide desired playing characteristics. For example, U.S. Pat. No. 5,184,828 claims to provide a golf ball having two core layers configured to provide superior rebound characteristics and carry distance, while maintaining adequate spin rate. More particularly, the patent teaches an inner core and an outer layer and controlling the hardness distribution in the outer layer and in the inner core in such a way that the golf ball has a maximum hardness at the outer site of the inner core. The patent alleges that such a distribution of hardness in the core assembly allows high energy to accumulate at the interface region where the hardness is at a maximum. The patent further claims that the energy of the club face is efficiently delivered to the maximum hardness region and transferred toward the inner core, resulting in a high rebound coefficient. However, since golf balls having hard cores and soft covers provide the most spin, the distribution taught by this patent would result in maximum core hardness at the interface when hit by a driver. Therein the ball has a relatively high driver spin rate and not very good distance. Since the ball in this patent has a softer outer core layer, the ball should have a lower spin rate for shorter shots such as an eight iron, where spin is more desirable. Thus, the ball taught by this patent appears to have many disadvantages.

U.S. Pat. No. 6,786,838 of Sullivan et al. discloses golf balls having at least three core layers (and up to six core layers) wherein the thickness of each core layer is at least twice as thick as an adjacent outer core layer and each core layer having a different hardness. The core layers have either progressively increasing or decreasing hardness from the innermost core layer to the outermost core layer.

However, none of these references discloses a multi-layered core golf ball wherein each core layer has a plurality of hardnesses and a hardness gradient (positive, negative or a combination) within each respective core layer in addition to a hardness gradient as between core layers.

Co-pending related U.S. patent application Ser. Nos. 12/469,258, 12/469,312, 12/492,514 and 12/492,570, incorporated herein by reference, disclose and claim golf balls having single layer cores comprising different regions of varying hardness within the single layer core. The present invention extends this to the multi-layer core golf ball in order to reduce or eliminate the increased manufacturing costs and difficulty which often result when the properties of inner core layers are undesirably altered or deteriorated as outer core layers are cured or otherwise mounted or formed around the inner core layer by applying heat. The inventive plurality of hardnesses and hardness gradient within each layer of the multi-layered golf balls of the present invention therefore provide and optimize all of the benefits of a multi-layer core golf ball meanwhile reducing and minimizing the number of core layers heretofore necessary in order to achieve and optimize those benefits.

SUMMARY OF THE INVENTION

A multi-layered core golf ball wherein each core layer comprises its own hardness gradient (positive, negative or a combination) in addition to an overall hardness gradient from one core layer to the next. The inventive golf balls of the invention may also include at least a cover layer surrounding the multi-layer core.

Section I:

In a first embodiment, the golf ball comprises a two layer core and a cover disposed about the two layer core. The two layer core comprises an inner core layer and an outer core layer disposed about the inner core layer. The inner core layer comprises a geometric center and a first outer surface. The inner core layer is formed from a substantially homogenous formulation, comprises a diameter of about 30 mm or lower, and has a plurality of hardnesses of from about 50 Shore C to about 80 Shore C. The geometric center comprises a first hardness and the first outer surface comprises a second hardness wherein the first hardness is different than the second hardness to define a positive or negative hardness gradient of about 20 Shore C or lower. The outer core layer comprises an inner surface and a second outer surface. The outer core layer is formed from a substantially homogenous formulation, comprises a thickness of about 10 mm or lower and has a plurality of hardnesses of from about 50 Shore C to about 80 Shore C. The inner surface comprises a third hardness and the second outer surface comprises a fourth hardness, wherein the fourth hardness is less than the third hardness to define a negative hardness gradient of about 15 Shore C or lower. The outer core layer further comprises a fifth hardness disposed between the inner surface and the second outer surface in a region extending between about 10% and about 90% of the distance from the inner surface to the second outer surface, wherein the fifth hardness is greater than the third hardness and the fourth hardness. Finally, the fourth hardness is less than the first hardness to define a negative hardness gradient of about 15 Shore C or lower.

As used herein, the phrase "plurality of hardnesses" includes the first, second, third, fourth and/or fifth hardnesses within the inner core and outer core layers as well as any additional hardnesses which may further define regions of varying hardness within each core layer as well as between core layers.

The first embodiment may alternatively include any combination of the following elements: The third hardness may be similar to the first hardness; the third hardness may be different from the second hardness to define a positive or negative hardness gradient; the fifth hardness may be disposed between the inner surface and the second outer surface in a region extending radially from the geometric center about 13 mm to about 20 mm; the diameter of the inner core layer may be about 26 mm or less; the first hardness may be greater than the second hardness to define a negative hardness gradient of about 15 Shore C or lower; the first hardness may be less than the second hardness to define a positive hardness gradient of about 15 Shore C or lower; the fourth hardness may be less than the third hardness to define a negative hardness gradient of about 10 Shore C or lower; the fourth hardness may be less than the first hardness to define a negative hardness gradient of about 10 Shore C or lower; and the plurality of hardnesses of the inner core layer and the outer core layer may range from about 55 Shore C to about 75 Shore C.

In a second embodiment, the dual layer core differs from that of the first embodiment at least in that: the fourth hardness is greater than the third hardness to define a positive hardness gradient of about 15 Shore C or lower or the fourth hardness is greater than the third hardness to define a positive hardness gradient of about 10 Shore C or lower; the fifth hardness is less than the third hardness and the fourth hardness; the fourth hardness is greater than the first hardness to define a positive hardness gradient of about 15 Shore C or lower or the fourth hardness is greater than the first hardness to define a positive hardness gradient of about 10 Shore C or lower.

In a third embodiment, the golf ball comprises a two layer core and a cover disposed about the two layer core. The two layer core comprises an inner core layer and an outer core layer disposed about the inner core layer. The inner core layer comprises a geometric center and a first outer surface. The inner core layer is formed from a substantially homogenous formulation, comprises a diameter of about 30 mm or lower, and has a plurality of hardnesses of from about 30 Shore D to about 60 Shore D. The geometric center comprises a first hardness and the first outer surface comprises a second hardness wherein the first hardness is different than the second hardness to define a positive or negative hardness gradient of about 15 Shore D or lower. The outer core layer comprises an inner surface and a second outer surface. The outer core layer is formed from a substantially homogenous formulation, comprises a thickness of about 10 mm or lower and has a plurality of hardnesses of from about 30 Shore D to about 60 Shore D. The inner surface comprises a third hardness and the second outer surface comprises a fourth hardness, wherein the fourth hardness is less than the third hardness to define a negative hardness gradient of about 15 Shore D or lower. The outer core layer further comprises a fifth hardness disposed between the inner surface and the second outer surface in a region extending between about 10% and about 90% of the distance from the inner surface to the second outer surface, wherein the fifth hardness is greater than the third hardness and the fourth hardness. Finally, the fourth hardness is less than the first hardness to define a negative hardness gradient of about 12 Shore D or lower.

The third embodiment may alternatively include any combination of the following elements: The third hardness may be similar to the first hardness; the third hardness may be different from the second hardness to define a positive or negative hardness gradient; the fifth hardness may be disposed between the inner surface and the second outer surface in a region extending radially from the geometric center about 13 mm to about 20 mm; the diameter of the inner core layer may be about 26 mm or less; the first hardness may be greater than the second hardness to define a negative hardness gradient of about 12 Shore D or lower; the first hardness may be less than the second hardness to define a positive hardness gradient of about 12 Shore D or lower; the fourth hardness may be less than the third hardness to define a negative hardness gradient of about 10 Shore D or lower; the fourth hardness may be less than the first hardness to define a negative hardness gradient of about 10 Shore D or lower; and the plurality of hardnesses of the inner core layer and the outer core layer may range from about 30 Shore D to about 60 Shore D.

In a fourth embodiment, the dual layer core differs from that of the third embodiment at least in that: the fourth hardness is greater than the third hardness to define a positive hardness gradient of about 15 Shore D or lower; the fifth hardness is less than the third hardness and the fourth hardness; and the fourth hardness is greater than the first hardness to define a positive hardness gradient of about 12 Shore D or lower.

In the third and fourth embodiments, the plurality of hardnesses of the inner core layer and the outer core layer may alternatively range from about 25 Shore D to about 45 Shore D.

In embodiments one through four, where the geometric center comprises a first hardness and the first outer surface comprises a second hardness wherein the first hardness is different than the second hardness to define a positive hardness gradient of about 20 Shore C or lower, the inner core layer may comprise zinc diacrylate in an amount of from about 25 phr to about 35 phr. Conversely, where the geometric center comprises a first hardness and the first outer surface comprises a second hardness wherein the first hardness is different than the second hardness to define a negative hardness gradient of about 20 Shore C or lower, the inner core layer may comprise zinc diacrylate in an amount of from about 30 phr to about 40 phr.

In embodiments one through four, the outer core layer may comprise zinc diacrylate in an amount of from about 25 phr to about 40 phr.

In embodiments one through four, the inner core layer may comprise antioxidant in an amount of 1.0 phr or less.

In embodiments one and three, the outer core layer may comprise antioxidant in an amount of from about 0.2 phr to about 1.2 phr. In embodiments two and four, the outer core layer comprises no antioxidant.

In embodiments one through four, where the geometric center comprises a first hardness and the first outer surface comprises a second hardness wherein the first hardness is different than the second hardness to define a positive hardness gradient of about 20 Shore C or lower, the inner core layer may comprise peroxide in an amount of from about 0.5 phr to about 1.0 phr. Alternatively, where the geometric center comprises a first hardness and the first outer surface comprises a second hardness wherein the first hardness is different than the second hardness to define a negative hardness gradient of about 20 Shore C or lower, the inner core layer may comprise peroxide in an amount of from about 0.5 phr to about 1.2 phr.

In embodiments one and three, the outer core layer may comprise peroxide in an amount of from about 0.5 phr to about 1.2 phr. In embodiments two and four, the outer core layer may comprise peroxide in an amount of from about 0.5 phr to about 1.5 phr.

In embodiments one through four, the inner core layer may comprise polybutadiene in an amount of about 100 phr and the outer core layer may comprise polybutadiene in an amount of from about 85 phr to about 100 phr.

In embodiments one through four, where the geometric center comprises a first hardness and the first outer surface comprises a second hardness wherein the first hardness is different than the second hardness to define a positive hardness gradient of about 20 Shore C or lower, the ratio of antioxidant to initiator for the inner core layer may be about 2.5 or less. In embodiments one through four, where the geometric center comprises a first hardness and the first outer surface comprises a second hardness wherein the first hardness is different than the second hardness to define a negative hardness gradient of about 20 Shore C or lower, the ratio of antioxidant to initiator for the inner core layer may be about 4.8 or less.

In embodiments one and three, the ratio of antioxidant to initiator for the outer core layer may be from about 0.33 to about 4.8. In embodiments two and four, there is no ratio of antioxidant to initiator for the outer core layer since the outer core layer does not comprise an antioxidant.

In embodiments one through four above, the inner core layer and outer core layer may each comprise zinc oxide in an amount of from about 5 phr to about 10 phr.

Additionally, the inner core layer and outer core layer may each comprise trans polyisoprene in an amount of about 15 phr or lower. Furthermore, the inner core layer and outer core layer may each comprise zinc pentachlorothiophenol in an amount of about 3 phr or less. Moreover, the inner core layer and outer core layer may each comprise regrind in an amount of from about 10 phr to about 30 phr.

Barium sulfate may be included in each core layer in an amount sufficient to target a desired specific gravity.

Section II:

In a first embodiment, the golf ball comprises a two layer core and a cover disposed about the two layer core. The two layer core comprises an inner core layer and an outer core layer disposed about the inner core layer. The inner core layer comprises a geometric center and a first outer surface. The inner core layer is formed from a substantially homogenous formulation, comprises a diameter of about 30 mm or lower and has a plurality of hardnesses of from about 40 Shore C to about 85 Shore C. The geometric center comprises a first hardness and the first outer surface comprises a second hardness wherein the second hardness is greater than the first hardness to define a positive hardness gradient of about 20 Shore C or greater. The outer core layer comprises an inner surface and a second outer surface. The outer core layer is formed from a substantially homogenous formulation, comprises a thickness of about 10 mm or lower and has a plurality of hardnesses of from about 65 Shore C to about 95 Shore C. The inner surface comprises a third hardness and the second outer surface comprises a fourth hardness wherein the fourth hardness is greater than the third hardness to define a positive hardness gradient of about 20 Shore C or lower. The outer core layer further comprises a fifth hardness disposed between the inner surface and the second outer surface in a region between about 10% and about 90% of the distance from the inner surface to the second outer surface, wherein the fifth hardness is greater than the third hardness and the fourth hardness. Finally, the fourth hardness is greater than the first hardness to define a positive hardness gradient of about 30 Shore C or greater.

The first embodiment may alternatively include the following elements: The third hardness may be similar to the second hardness; the fifth hardness may be disposed between the inner surface and the second outer surface in a region extending radially from about 13 mm to about 20 mm from the geometric center; the diameter of the inner core layer may be about 26 mm or lower; the second hardness is greater than the first hardness to define a positive hardness gradient of about 30 Shore C or greater; the fourth hardness is greater than the third hardness to define a positive hardness gradient of about 10 Shore C or lower; the fourth hardness is greater than the first hardness to define a positive hardness gradient of about 35 Shore C or greater; and the plurality of hardnesses of the inner core layer and outer core layer may also range from about 50 Shore C to about 80 Shore C and from about 75 Shore C to about 95 Shore C, respectively.

In a second embodiment, the dual layer core differs from that of the first embodiment at least in that: the fourth hardness is less than the third hardness to define a negative hardness gradient of about 20 Shore C or lower or the fourth hardness is less than the third hardness to define a negative hardness gradient of about 10 Shore C or lower; the fifth hardness is less than the third hardness and the fourth hardness; the fourth hardness is greater than the first hardness to define a positive hardness gradient of about 20 Shore C or greater or the fourth hardness is greater than the first hardness to define a positive hardness gradient of about 25 Shore C or greater; the second hardness is greater than the first hardness to define a positive hardness gradient of about 30 Shore C or greater.

In a third embodiment, the inner core layer has a plurality hardnesses of from about 25 Shore D to about 60 Shore D and the second hardness is greater than the first hardness to define a positive hardness gradient of about 20 Shore D or greater. The outer core layer in this embodiment has a plurality hardnesses of from about 40 Shore D to about 66 Shore D. The relative outer core layer hardnesses are as follows: the fourth hardness is greater than the third hardness to define a positive hardness gradient of about 15 Shore D or lower; the fifth hardness is greater than the third hardness and the fourth hardness; the third hardness is substantially the same as the second hardness; and the fourth hardness is greater than the first hardness to define a positive hardness gradient of about 25 Shore D or greater.

The third embodiment may alternatively include the following elements: The third hardness may be similar to the second hardness; the fifth hardness may be disposed between the inner surface and the second outer surface in a region extending radially from about 13 mm to about 20 mm from the geometric center; the diameter of the inner core layer may be about 26 mm or lower; the second hardness may be greater than the first hardness to define a positive hardness gradient of about 25 Shore D or greater; the fourth hardness may be greater than the first hardness to define a positive hardness gradient of about 30 Shore D or greater; and the plurality of hardnesses of the inner core layer and the outer core layer may also range from about 20 Shore D to about 50 Shore D and from about 45 Shore D to about 60 Shore D, respectively.

In a fourth embodiment, the dual layer core differs from that of the third embodiment at least that: the fourth hardness is less than the third hardness to define a negative hardness gradient of about 15 Shore D or lower; the fifth hardness is less than the third hardness and the fourth hardness; and the fourth hardness is greater than the first hardness to define a positive hardness gradient of about 20 Shore D or greater or the fourth hardness may be greater than the first hardness to define a positive hardness gradient of about 25 Shore D or greater.

In the first and third embodiments, the inner core layer may comprise zinc diacrylate in an amount of from about 35 phr to about 45 phr and the outer core layer comprises zinc diacrylate in an amount of from about 39 phr to about 45 phr.

In the second and fourth embodiments, the inner core layer may comprise zinc diacrylate in an amount of from about 35 phr to about 45 phr and the outer core layer comprises zinc diacrylate in an amount of from about 35 phr to about 42 phr.

In each embodiment above, the inner core layer does not comprise antioxidant. However, other embodiments are envisioned in which the inner core layer may comprise antioxidant. In each embodiment, the outer core layer may comprise antioxidant in an amount of from about 0.2 phr to about 1.0 phr.

In each embodiment above, the inner core layer may comprise peroxide in an amount of about 1.2 phr or less. In another embodiment, however, the inner core layer may comprise peroxide in an amount of about 2.0 phr or less.

In embodiments one and three above, the outer core may comprise peroxide in an amount of from about 0.8 phr to about 1.5 phr. In embodiments two and four, the outer core layer may comprise peroxide in an amount of from about 0.6 phr to about 1.2 phr.

In each embodiment above, the inner core layer does not have a ratio of antioxidant to initiator since the inner core layer does not comprise an antioxidant. However, embodiments are envisioned wherein the inner core layer does indeed comprise a ratio of antioxidant to initiator.

In embodiments one and three, the ratio of antioxidant to initiator for the outer core layer may be from about 0.27 to about 2.5. In embodiments two and four, the ratio of antioxidant to initiator for the outer core layer may be from about 0.33 to about 3.33.

In embodiments one through four, the inner core layer and the outer core layer may each comprise zinc oxide in an amount of from about 5 phr to about 10 phr. Additionally, the inner core layer may comprise polybutadiene in an amount of about 100 phr and the outer core layer may comprise polybutadiene in an amount of from about 85 phr to about 100 phr. Furthermore, the inner core layer and the outer core layer may each comprise trans polyisoprene in an amount of about 15 phr or lower. Moreover, the inner core layer and the outer core layer may each comprise zinc pentachlorothiophenol in an amount of about 3 phr or less. Meanwhile, the inner core layer and the outer core layer may each comprise regrind in an amount of from about 10 phr to about 30 phr.

In each embodiment, barium sulfate may be included in each core layer in an amount sufficient to target a desired specific gravity.

Examples of additional embodiments are as follows. The outer core layer may comprise antioxidant in an amount of from about 0.2 phr to about 2.0 phr. The inner core layer may comprises peroxide in an amount of from about 0.2 phr to about 2.0 phr and the outer core may comprise peroxide in an amount of from about 0.3 phr to about 2.5 phr. The ratio of antioxidant to peroxide for the outer core layer may be about 2.5 or less.

Section III:

In a first embodiment, the golf ball comprises a two layer core and a cover disposed about the two layer core. The two layer core comprises an inner core layer and an outer core layer disposed about the inner core layer. The inner core layer comprises a geometric center and a first outer surface. The inner core layer is formed from a substantially homogenous formulation, comprises a diameter of about 30 mm or lower, and has a plurality of hardnesses of from about 60 Shore C to about 85 Shore C. The geometric center comprises a first hardness and the first outer surface comprises a second hardness wherein the second hardness is greater than the first hardness to define a positive hardness gradient of from about 5 Shore C to about 20 Shore C.

The outer core layer comprises an inner surface and a second outer surface. The outer core layer is formed from a substantially homogenous formulation, comprises a thickness of about 10 mm or lower, and has a plurality of hardnesses of from about 60 Shore C to about 95 Shore C. The inner surface comprises a third hardness and the second outer surface comprises a fourth hardness wherein the fourth hardness is greater than the third hardness to define a positive hardness gradient of about 20 Shore C or lower. The outer core layer further comprises a fifth hardness disposed between the inner surface and the second outer surface in a region extending between about 10% and about 90% of the distance from the inner surface to the second outer surface, wherein the fifth hardness is greater than the third hardness and the fourth hardness. Finally, the fourth hardness is greater than the first hardness to define a positive hardness gradient of about 30 Shore C or lower.

The first embodiment may alternatively include the following elements: The third hardness may be similar to the second hardness; the fifth hardness may be disposed between the inner surface and the second outer surface in a region extending radially from about 13 mm to about 20 mm from the geometric center; the diameter of the inner core layer may be about 26 mm or lower; the fourth hardness may be greater than the third hardness to define a positive hardness gradient of about 10 Shore C or lower; the fourth hardness may be greater than the first hardness to define a positive hardness gradient of about 25 Shore C or lower; and the inner core layer and outer core layer may have a plurality of hardnesses of from about 65 Shore C to about 75 Shore C and from about 70 shore C to about 85 Shore C, respectively.

In a second embodiment, the dual layer core differs from that of the first embodiment at least in that: the fourth hardness is less than the third hardness to define a negative hardness gradient of about 20 Shore C or lower or the fourth hardness may be less than the third hardness to define a negative hardness gradient of about 10 Shore C or lower; the fifth hardness is less than the third hardness and the fourth hardness; and the fourth hardness is greater than the first hardness to define a positive hardness gradient of about 18 Shore C or lower or the fourth hardness may be greater than the first hardness to define a positive hardness gradient of about 15 Shore C or lower.

In a third embodiment, the inner core layer has a plurality of hardnesses of from about 35 Shore D to about 58 Shore D and the second hardness is greater than the first hardness to define a positive hardness gradient of from about 3 Shore D to about 20 Shore D. The outer core layer has a plurality of hardnesses of from about 40 Shore D to about 69 Shore D, and the relative outer core layer hardnesses are as follows: the fourth hardness is greater than the third hardness to define a positive hardness gradient of about 15 Shore D or lower; the fifth hardness is greater than the third hardness and the fourth hardness; and the fourth hardness is greater than the first hardness to define a positive hardness gradient of about 30 Shore D or lower.

The third embodiment may alternatively include the following elements: The third hardness may be similar to the second hardness; the fifth hardness may be disposed between the inner surface and the second outer surface in a region extending radially from about 13 mm to about 20 mm from the geometric center; the second hardness may be greater than the first hardness to define a positive hardness gradient of from about 5 Shore D to about 15 Shore D; the fourth hardness may be greater than the third hardness to define a positive hardness gradient of about 10 Shore D or lower; the fourth hardness may be greater than the first hardness to define a positive hardness gradient of about 22 Shore D or lower; and the inner core layer and outer core layer may also have a plurality of hardnesses of from about 35 to about 45 Shore D and from about 40 Shore D to about 56 Shore D, respectively.

In a fourth embodiment, the dual layer core differs from that of the third embodiment at least in that: the second hardness is greater than the first hardness to define a positive hardness gradient of from about 5 Shore D to about 15 Shore D; the fourth hardness is less than the third hardness to define a negative hardness gradient of about 15 Shore D or lower or the fourth hardness is less than the third hardness to define a negative hardness gradient of about 10 Shore D or lower; the fifth hardness is less than the third hardness and the fourth hardness; and the fourth hardness is greater than the first hardness to define a positive hardness gradient of about 20 Shore D or lower or the fourth hardness is greater than the first hardness to define a positive hardness gradient of about 18 Shore D or lower.

In the first and third embodiments, the inner core layer may comprise zinc diacrylate in an amount of from about 35 phr to about 45 phr and the outer core layer may comprise zinc diacrylate in an amount of from about 39 phr to about 45 phr.

In the second and fourth embodiments, the inner core layer may comprise zinc diacrylate in an amount of from about 35 phr to about 45 phr and the outer core layer may comprise zinc diacrylate in an amount of from about 35 phr to about 42 phr.

In each of the embodiments above, the inner core layer may comprise antioxidant in an amount of about 1.0 phr or less and the outer core layer may comprise an antioxidant in an amount of from about 0.2 phr to about 1.0 phr.

In each of the embodiments above, the inner core layer may comprise peroxide in an amount of from about 0.5 phr to about 1.0 phr.

In the first and third embodiments, the outer core layer may comprise peroxide in an amount of from about 0.8 phr to about 1.5 phr. In the second and fourth embodiments, the outer core layer may comprise peroxide in an amount of from about 0.6 phr to about 1.2 phr.

In each embodiment above, the ratio of antioxidant to initiator for the inner core layer may be about 2.5 or less.

In the first and third embodiments, the ratio of antioxidant to initiator for the outer core layer may be from about 0.27 to about 2.5. In the second and fourth embodiments, the ratio of antioxidant to initiator for the outer core layer may be from about 0.33 to about 3.33.

In each embodiment, the inner core layer may comprise polybutadiene in an amount of about 100 phr and the outer core layer may comprise polybutadiene in an amount of from about 85 phr to about 100 phr.

In the four embodiments above, the inner core layer and the outer core layer may each comprise zinc oxide in an amount of from about 5 phr to about 10 phr.

In the four embodiments above, the inner core layer and the outer core layer may each comprise trans polyisoprene in an amount of about 15 phr or lower.

In the four embodiments above, the inner core layer and the outer core layer may each comprise zinc pentachlorothiophenol in an amount of about 3 phr or less.

In the four embodiments above, the inner core layer and the outer core layer may each comprise regrind in an amount of from about 10 phr to about 30 phr.

In the four embodiments above, barium sulfate may be included in each core layer in an amount sufficient to target a desired specific gravity.

Examples of other embodiments are as follows. The inner core layer may comprise antioxidant in an amount of about 1.8 phr or less and the outer core layer may comprise antioxidant in an amount of from about 0.2 phr to about 2.0 phr. The inner core layer may comprise peroxide in an amount of from about 0.5 phr to about 2.0 phr and the outer core layer may comprise peroxide in an amount of from about 0.6 phr to about 2.5 phr. The ratio of antioxidant to initiator for the inner core layer may be about 2.5 or lower.

Section IV:

In a first embodiment, the golf ball comprises a two layer core and a cover disposed about the two layer core. The two layer core comprises an inner core layer and an outer core layer disposed about the inner core layer. The inner core layer comprises a geometric center and a first outer surface. The inner core layer is formed from a substantially homogenous formulation, comprises a diameter of about 30 mm or lower, and has a plurality of hardnesses of from about 50 Shore C to about 90 Shore C. The geometric center comprises a first hardness and the first outer surface comprises a second hardness wherein the first hardness is greater than the second hardness to define a negative hardness gradient of about 20 Shore C or greater. The outer core layer comprises an inner surface and a second outer surface. The outer core layer is formed from a substantially homogenous formulation, comprises a thickness of about 10 mm or lower, and has a plurality of hardnesses of from about 50 Shore C to about 95 Shore C. The inner surface comprises a third hardness and the second outer surface comprises a fourth hardness wherein the fourth hardness is greater than the third hardness to define a positive hardness gradient of about 20 Shore C or greater. The outer core layer further comprises a fifth hardness disposed between the inner surface and the second outer surface in a region extending between about 10% and about 90% of the distance from the inner surface to the second outer surface, wherein the fifth hardness is greater than the first hardness, the third hardness and the fourth hardness. Finally, the fourth hardness is similar to or less than the first hardness.

The first embodiment may alternatively include the following elements: The third hardness may be similar to the second hardness; the fifth hardness may be disposed between the inner surface and the second outer surface in a region extending radially from about 13 mm to about 20 mm from the geometric center; the diameter of the inner core layer may be about 26 mm or lower; the first hardness may be greater than the second hardness to define a negative hardness gradient of about 20 Shore C or greater; and the fourth hardness may be greater than the third hardness to define a positive hardness gradient of about 25 Shore C or greater.

In a second embodiment, the dual layer core differs from that of the first embodiment at least in that: the plurality of hardnesses of the outer core layer is from about 50 Shore C to about 80 Shore C; the fifth hardness is similar to or less than the first hardness and is greater than the third hardness; the fourth hardness is greater than the third hardness to define a positive hardness gradient of about 15 Shore C or lower or about 10 Shore C or lower; the fourth hardness is less than the first hardness.

In a third embodiment, the dual layer core differs from that of the first embodiment at least in that: the plurality of hardnesses of the outer core layer is from about 40 Shore C to about 75 Shore C; the fourth hardness is similar to or less than the third hardness; and the fifth hardness is less than the third hardness and the fourth hardness.

Alternatively, in the first embodiment, the plurality of hardnesses of the inner core layer and the outer core layer may range from about 55 Shore C to about 85 Shore C and from about 55 Shore C to about 90 Shore C, respectively. In the second embodiment, the plurality of hardnesses of the inner core layer and the outer core layer may each also range from about 55 Shore C to about 85 Shore C. In the third embodiment, the plurality of hardnesses of the inner core layer and the outer core layer may additionally range from about 55 Shore C to about 85 Shore C and from about 50 Shore C to about 85 Shore C, respectively.

In a fourth embodiment, the golf ball comprises a two layer core and a cover disposed about the two layer core. The two layer core comprises an inner core layer and an outer core layer disposed about the inner core layer. The inner core layer comprises a geometric center and a first outer surface. The inner core layer is formed from a substantially homogenous formulation, comprises a diameter of about 30 mm or lower, and has a plurality of hardnesses of from about 30 Shore D to about 68 Shore D. The geometric center comprises a first hardness and the first outer surface comprises a second hardness, wherein the first hardness is greater than the second hardness to define a negative hardness gradient of about 20 Shore D or greater. The outer core layer comprises an inner surface and a second outer surface. The outer core layer is formed from a substantially homogenous formulation, comprises a thickness of about 10 mm or lower, and has a plurality of hardnesses of from about 30 Shore D to about 68 Shore D. The inner surface comprises a third hardness and the second outer surface comprises a fourth hardness, wherein the fourth hardness is greater than the third hardness to define a positive hardness gradient of about 20 Shore D or greater. The outer core layer further comprises a fifth hardness disposed between the inner surface and the second outer surface in a region extending between about 10% and about 90% of the distance from the inner surface to the second outer surface, wherein the fifth hardness is greater than the first hardness, the third hardness and the fourth hardness. Finally, the fourth hardness is similar to or less than the first hardness.

The fourth embodiment may alternatively include the following elements: The third hardness may be similar to the second hardness; the fifth hardness may be disposed between the inner surface and the second outer surface in a region extending radially from about 13 mm to about 20 mm from the geometric center; the diameter of the inner core layer may be about 26 mm or lower; the first hardness may be greater than the second hardness to define a negative hardness gradient of about 25 Shore D or greater; and the fourth hardness may be greater than the third hardness to define a positive hardness gradient of about 25 Shore D or greater.

In a fifth embodiment, the dual layer core differs from that of the fourth embodiment at least in that: The outer core layer has a plurality of hardnesses of from about 30 Shore D to about 55 Shore D; the fourth hardness is greater than the third hardness to define a positive hardness gradient of about 10 Shore D or lower; the fifth hardness is similar to or less than the first hardness; and the fourth hardness is less than the first hardness.

In a sixth embodiment, the dual layer core differs from that of the fourth and fifth embodiments at least in that: the plurality of hardnesses of the outer core layer is from about 25 Shore D to about 45 Shore D; the fourth hardness is similar to or less than the third hardness; and the fifth hardness is less than the third hardness and the fourth hardness.

Alternatively, in the fourth embodiment, the plurality of hardnesses of the inner core layer and the outer core layer may range from about 25 Shore D to about 56 Shore D and from about 25 Shore D to about 60 Shore D, respectively. In the fifth embodiment, the plurality of hardnesses of the inner core layer and the outer core layer may each also range from about 25 Shore D to about 56 Shore D. In the sixth embodiment, the plurality of hardnesses of the inner core layer and the outer core layer may range from about 25 Shore D to about 56 Shore D and from about 20 Shore D to about 56 Shore D, respectively.

In embodiments one through six, the inner core layer may comprise antioxidant in an amount of from about 0.2 phr to about 1.2 phr. Additionally, the inner core layer may comprise peroxide in an amount of from about 0.5 phr to about 1.2 phr. The resulting ratio of antioxidant to initiator of the inner core layer may be from about 0.33 to about 4.8.

In embodiments one and four, the outer core layer may not comprise any antioxidant. However, it is envisioned that the formulation for embodiments one and four may be modified so that the outer core layer does indeed comprise antioxidant.

In embodiments two and five, the outer core layer may comprise antioxidant in an amount of about 1.0 phr or less.

In embodiments three and six, the outer core layer may comprise antioxidant in an amount of from about 0.2 phr to about 1.2 phr.

The inner and outer core may comprise peroxide as disclosed in Table I herein, including either a single peroxide or a combination of peroxides.

In embodiments one and six, the ratio of antioxidant to initiator of the outer core layer is zero where the outer core layer does not comprise any antioxidant. In embodiments two and five, the ratio of antioxidant to initiator of the outer core layer may be about 10.0 or less. In embodiments three and six, the ratio of antioxidant to initiator of the outer core layer may be from about 0.33 to about 4.8.

In each of embodiments one through six, the inner core layer may comprise polybutadiene in an amount of about 100 phr and the outer core layer may comprise polybutadiene in an amount of from about 85 phr to about 100 phr. Furthermore, the inner core layer may comprise zinc diacrylate in an amount of from about 40 phr to about 50 phr and the outer core layer may comprise zinc diacrylate in an amount of from about 30 phr to about 45 phr. Additionally, the inner core layer and the outer core layer may each comprise zinc oxide in an amount of from about 5 phr to about 10 phr. Moreover, the inner core layer and the outer core layer may each comprise zinc pentachlorothiophenol in an amount of about 3 phr or less. Further, the inner core layer and the outer core layer may each comprise regrind in an amount of from about 10 phr to about 30 phr. In addition, the inner core layer and the outer core layer may each comprise trans polyisoprene in an amount of about 15 phr or less. Barium sulfate may be included in each core layer in an amount sufficient to target a desired specific gravity.

In an alternative embodiment, the inner core layer and the outer core layer each comprises peroxide in an amount of from about 0.2 phr to about 3.0 phr and antioxidant in an amount of about 2.5 phr or less.

Section V:

In a first embodiment, the golf ball comprises a two layer core and a cover disposed about the two layer core. The two layer core comprises an inner core layer and an outer core layer disposed about the inner core layer. The inner core layer comprises a geometric center and a first outer surface. The inner core layer is formed from a substantially homogenous formulation, comprises a diameter of about 30 mm or lower, and has a plurality of hardnesses of from about 50 Shore C to about 80 Shore C. The geometric center comprises a first hardness and the first outer surface comprises a second hardness, wherein the first hardness is greater than the second hardness to define a negative hardness gradient about 20 Shore C or less. The outer core layer comprises an inner surface and a second outer surface. The outer core layer is formed from a substantially homogenous formulation, comprises a thickness of about 10 mm or lower, and has a plurality of hardnesses of from about 50 Shore C to about 90 Shore C. The inner surface comprises a third hardness and the second outer surface comprises a fourth hardness, wherein the fourth hardness is greater than the third hardness. The outer core layer further comprises a fifth hardness disposed between the inner surface and the second outer surface in a region extending between about 10% and about 90% of the distance from the inner surface to the second outer surface, wherein the fifth hardness is greater than the first hardness, the third hardness and the fourth hardness. Finally, the fourth hardness is greater than the first hardness to define a two layer core having a positive hardness gradient of less than about 20 Shore C.

The first embodiment may alternatively include any combination of the following elements: The third hardness may be similar to the first hardness; the fifth hardness may be disposed between the inner surface and the second outer surface in a region extending radially from the geometric center about 13 mm to about 20 mm; the diameter of the inner core layer may be about 26 mm or less; the first hardness may be greater than the second hardness to define a negative hardness gradient of about 15 Shore C or less; the fourth hardness may be greater than the first hardness to define a two layer core having a positive hardness gradient of less than about 15 Shore C.

In a second embodiment, the dual layer core differs from that of the first embodiment at least in that: The outer core has a plurality of hardnesses of from about 50 Shore C to about 80 Shore C, the fifth hardness is greater than the third hardness and the fourth hardness and similar to the first hardness; and the fourth hardness is less than the first hardness to define a two layer core having a negative hardness gradient of less than about 10 Shore C or the fourth hardness is less than the first hardness to define a two layer core having a negative hardness gradient of less than about 7 Shore C.

In a third embodiment, the dual layer core differs from that of the first embodiment at least in that: The outer core layer has a plurality of hardnesses of from about 45 Shore C to about 80 Shore C, the fifth hardness is less than the third hardness and the fourth hardness, and the fourth hardness is less than the first hardness to define a two layer core having a negative hardness gradient of no greater than about 20 Shore C or the fourth hardness is less than the first hardness to define a two layer core having a negative hardness gradient of no greater than about 15 Shore C.

In a fourth embodiment, the dual layer core differs from that of the first embodiment at least in that: The outer core layer has a plurality of hardnesses of from about 50 Shore C to about 80 Shore C; the first hardness is greater than the second hardness to define a negative hardness gradient of about 23 Shore C or less or the first hardness is greater than the second hardness to define a negative hardness gradient of about 18 Shore C or less; the fourth hardness is similar to the first hardness; and there is no fifth hardness as defined in the first embodiment.

In a fifth embodiment, the dual layer core differs from that of the first embodiment at least in that: The outer core layer has a plurality of hardnesses of from about 45 Shore C to about 80 Shore C, the fourth hardness is less than the first hardness to define a two layer core having a negative hardness gradient of no greater than about 15 Shore C or the fourth hardness is greater than the first hardness by 5 Shore C or less; and the fifth hardness is less than the third hardness and the fourth hardness.

Alternatively, in the first embodiment the plurality of hardnesses of the inner core layer and the outer core layer may range from about 45 Shore C to about 75 Shore C and from about 45 Shore C to about 80 Shore C, respectively. In the second and fourth embodiments, the plurality of hardnesses of the inner core layer and the outer core layer may each also range from about 45 Shore C to about 75 Shore C. In the third and fifth embodiments, the plurality of hardnesses of the inner core layer and the outer core layer may additionally range from about 55 Shore C to about 85 Shore C and from about 50 Shore C to about 85 Shore C, respectively.

In a sixth embodiment, the golf ball comprises a two layer core and a cover disposed about the two layer core. The two layer core comprises an inner core layer and an outer core layer disposed about the inner core layer. The inner core layer comprises a geometric center and a first outer surface. The inner core layer is formed from a substantially homogenous formulation, comprises a diameter of about 30 mm or less, and has a plurality of hardnesses of from about 25 Shore D to about 55 Shore D. The geometric center comprises a first hardness and the first outer surface comprises a second hardness, wherein the first hardness is greater than the second hardness to define a negative hardness gradient of about 20 Shore D or less.

The outer core layer comprises an inner surface and a second outer surface. The outer core layer is formed from a substantially homogenous formulation, comprises a thickness of about 10 mm or less and has a plurality of hardnesses of from about 30 Shore D to about 69 Shore D. The inner surface comprises a third hardness and the second outer surface comprises a fourth hardness, wherein the fourth hardness is greater than the third hardness. The outer core layer further comprises a fifth hardness disposed between the inner surface and the second outer surface in a region extending between about 10% and about 90% of the distance from the inner surface to the second outer surface, wherein the fifth hardness is greater than the third hardness and the fourth hardness. Finally, the fourth hardness is greater than the first hardness to define a positive hardness gradient of less than about 45 Shore D.

In a seventh embodiment, the dual layer core differs from that of the first embodiment at least in that: The outer core layer comprises a plurality of hardnesses of from about 30 Shore D to about 52 Shore D, the fifth hardness is greater than the third hardness and the fourth hardness or the fifth hardness is greater than the third hardness and the fourth hardness and similar to the first hardness; and the fourth hardness is less than the first hardness to define a two layer core having a negative hardness gradient of no greater than about 10 Shore D or the fourth hardness is less than the first hardness to define a two layer core having a negative hardness gradient of no greater than about 8 Shore D.

In an eighth embodiment, the dual layer core differs from that of the first embodiment at least in that: The outer core layer comprises a plurality of hardnesses of from about 25 Shore D to about 40 Shore D; the fourth hardness is greater than the third hardness or the fourth hardness is less than the third hardness; and the fourth hardness is less than the first hardness to define a two layer core having a negative hardness gradient of from about 10 Shore D to about 25 Shore D or the fourth hardness is less than the first hardness to define a two layer core having a negative hardness gradient of from about 13 Shore D to about 21 Shore D.

In a ninth embodiment, the dual layer core differs from that of the first embodiment at least in that: The outer core layer comprises a plurality of hardnesses of from about 20 Shore D to about 55 Shore D; the first hardness is greater than the second hardness to define a negative hardness gradient of about 25 Shore D or less; the fourth hardness is similar to the first hardness or the fourth hardness is greater than the third hardness; and there is no fifth hardness as defined in the first embodiment.

In a tenth embodiment, the dual layer core differs from that of the first embodiment at least in that: The outer core layer comprises a plurality of hardnesses of from about 15

Shore D to about 50 Shore D, the fifth hardness is less than the third hardness and the fourth hardness, and the fourth hardness is less than the fourth hardness to define a two layer core having a negative gradient of no greater than about 10 Shore D or the fourth hardness is greater than the first hardness.

Alternatively, in the sixth embodiment, the plurality of hardnesses of the inner core layer and the outer core layer may range from about 25 Shore D to about 45 Shore D and from about 25 Shore D to about 58 Shore D, respectively. In the seventh and ninth embodiments, the plurality of hardnesses of the inner core layer and the outer core layer may instead range from about 25 Shore D to about 45 Shore D. Optionally, in the eighth and tenth embodiments, the plurality of hardnesses of the inner core layer and the outer core layer may range from about 25 Shore D to about 45 Shore D and from about 15 Shore D to about 45 Shore D, respectively.

In embodiments one through ten, the inner core layer may comprise antioxidant in an amount of from about 0.2 phr to about 1.2 phr. Additionally, in embodiments one through ten, the inner core layer may comprise peroxide in an amount of from about 0.5 phr to about 1.2 phr. The resulting ratio of antioxidant to initiator of the inner core layer in these embodiments may be from about 0.33 to about 4.8

In embodiments one and six, the outer core layer may not comprise any antioxidant. However, it is envisioned and appreciated that the formulation for embodiments one and six may be modified such that the outer core layer does indeed comprise antioxidant.

In embodiments two and seven, the outer core layer may comprise antioxidant in an amount of about 1.0 phr or less.

In embodiments three and eight, the outer core layer may comprise antioxidant in an amount of from about 0.2 phr to about 1.2 phr.

In embodiments four and nine, the outer core layer may comprise antioxidant in an amount of 0.5 phr or less.

In embodiments five and ten, the outer core layer may comprise antioxidant in an amount of 1.0 phr or less.

In embodiments one and six, the outer core layer may comprise peroxide in an amount of from about 0.5 phr to about 1.0 phr.

In embodiments two and seven, the outer core layer may comprise peroxide in an amount of from about 0.2 phr to about 0.8 phr. Alternatively, in embodiments two and seven, the outer core layer may comprise peroxide in an amount of about 1.0 phr or less.

In embodiments three and eight, the outer core layer may comprise peroxide in an amount of from about 0.5 phr to about 1.2 phr.

In embodiments four, five, nine and ten, the outer core layer may comprise peroxide in an amount of 1.5 phr or less.

Accordingly, in embodiments one and six, the ratio of antioxidant to initiator of the outer core layer may be about 0. In embodiments two and seven, the ratio of antioxidant to initiator of the outer core layer may be about 10.0 or less. In embodiments three and eight, the ratio of antioxidant to initiator of the outer core layer may be about 0.33 to about 4.8. In embodiments four and nine, the ratio of antioxidant to initiator of the outer core layer may be 1.0 or less. Finally, in embodiments five and ten, the ratio of antioxidant to initiator of the outer core layer may be about 2.0 or less.

In each of embodiments one through ten, the inner core layer may comprise polybutadiene in an amount of about 100 phr and the outer core layer may comprise polybutadiene in an amount of from about 85 phr to about 100 phr. Additionally, for each embodiment one through ten, the inner core layer may comprise zinc diacrylate in an amount of from about 25 phr to about 35 phr and the outer core layer may comprise zinc diacrylate in an amount of from about 30 phr to about 45 phr. Furthermore, the inner core layer and the outer core layer may each comprise trans polyisoprene in an amount of about 15 phr or less. Moreover, the inner core layer and the outer core layer may each comprise zinc oxide in an amount of from about 5 phr to about 10 phr. In addition, the inner core layer and the outer core layer each comprises zinc pentachlorothiophenol in an amount of about 3 phr or less. Further, the inner core layer and the outer core layer may each comprise regrind in an amount of from about 10 phr to about 30 phr. Barium sulfate may be included in each core layer in an amount sufficient to target a desired specific gravity.

Examples of other embodiments are as follows. The inner core layer may comprise antioxidant in an amount of from about 0.2 phr to about 2.5 phr and the outer core layer may comprise antioxidant in an amount of about 1.2 phr or less. The inner core layer may comprise peroxide in an amount of from about 0.5 phr to about 2.0 phr and the outer core may comprise peroxide in an amount of from about 0.6 phr to about 2.5 phr. The ratio of antioxidant to peroxide for the inner core layer may be about 2.5 or less. The ratio of antioxidant to peroxide for the outer core layer may be about 2.0 or less.

It is preferred that the golf ball of the present invention comprise two core layers and a cover in order to maximize the benefits achieved from such a golf ball construction—namely reducing or eliminating the increased manufacturing costs and difficulty which often result when the properties of inner core layers are undesirably altered or deteriorated as outer core layers are cured or otherwise mounted or formed around the inner core layer by applying heat. However, it is recognized and envisioned that the inventive golf ball may comprise and extend to any number of core layers, intermediate layers, and/or cover layers having regions of varying hardness within and between each layer.

BRIEF DESCRIPTION OF THE DRAWINGS

In the accompanying drawings which forms a part of the specification and is to be read in conjunction therewith.

DETAILED DESCRIPTION OF THE PREFERRED EMBODIMENTS

Figure 1:
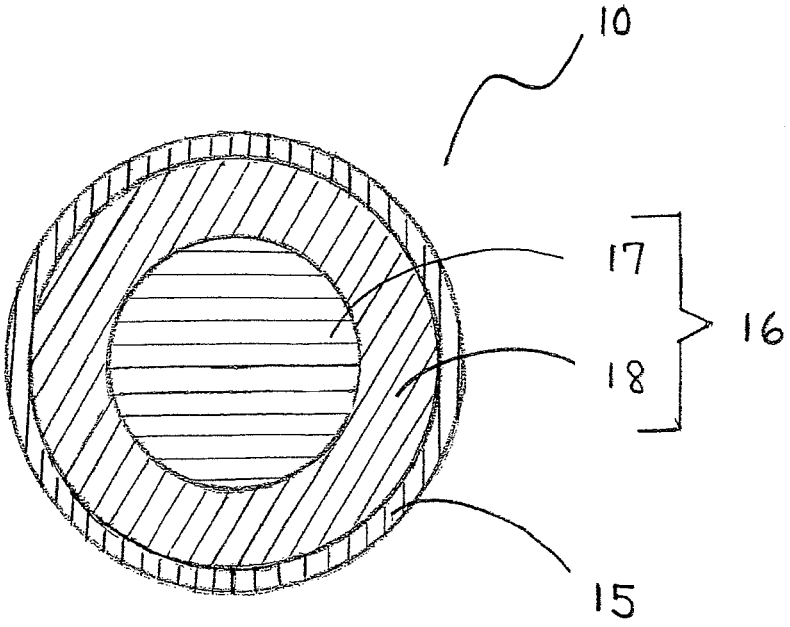
FIG. 1 is a cross-sectional view of a golf ball formed according to one embodiment of the present invention.

As briefly discussed above, each inventive core layer may have a hardness gradient defined by hardness measurements made at the surface of the inner core (or outer core layer) and radially inward toward the center of the inner core, typically at 2-mm increments. As used herein, the terms "negative" and "positive" refer to the result of subtracting the hardness value at the innermost portion of the component being measured from the hardness value at the outer surface of the component being measured. For example, if the outer surface of a core layer has a greater hardness value than its innermost surface, the hardness gradient will be deemed a "positive" gradient. Alternatively, if the inner surface of one layer of a multi-layer core has a greater hardness value than its inner surface, the hardness gradient for that core layer will be deemed a "negative" gradient.

Each region of a core layer (inner core region, or outer core region or intermediate core region) may be made from a composition including at least one thermoset base rubber, such as a polybutadiene rubber, cured with at least one peroxide and at least one reactive co-agent, which can be a metal salt of an unsaturated carboxylic acid, such as acrylic acid or methacrylic acid, a non-metallic coagent, or mixtures thereof. Preferably, a suitable antioxidant is included in the composition. An optional soft and fast agent (and sometimes a cis-to-trans catalyst), such as an organosulfur or metal-containing organosulfur compound, can also be included in the core formulation.

Other ingredients that are known to those skilled in the art may be used, and are understood to include, but not be limited to, density-adjusting fillers, process aides, plasticizers, blowing or foaming agents, sulfur accelerators, and/or non-peroxide radical sources.

The base thermoset rubber, which can be blended with other rubbers and polymers, typically includes a natural or synthetic rubber. A preferred base rubber is 1,4-polybutadiene having a cis structure of at least 40%, preferably greater than 80%, and more preferably greater than 90%.

Examples of desirable polybutadiene rubbers include BUNA® CB22 and BUNA® CB23, TAKTENE® 1203G1, 220, 221, and PETROFLEX® BRNd-40, commercially available from LANXESS Corporation; BR-1220 available from BST Elastomers Co. LTD; UBEPOL® 360L and UBEPOL® 150L and UBEPOL-BR rubbers, commercially available from UBE Industries, Ltd. of Tokyo, Japan; KINEX® 7245 and KINEX® 7265, commercially available from Goodyear of Akron, Ohio; SE BR-1220, commercially available from Dow Chemical Company; Europrene® NEOCIS® BR 40 and BR 60, commercially available from Polimeri Europa; and BR 01, BR 730, BR 735, BR 11, and BR 51, commercially available from Japan Synthetic Rubber Co., Ltd; and KARBOCHEM® ND40, ND45, and ND60, commercially available from Karbochem.

The base rubber may also comprise high or medium Mooney viscosity rubber, or blends thereof. The measurement of Mooney viscosity is defined according to ASTM D-1646.

The Mooney viscosity range is preferably greater than about 30, more preferably in the range from about 35 to about 75 and more preferably in the range from about 40 to about 60. Polybutadiene rubber with higher Mooney viscosity may also be used, so long as the viscosity of the polybutadiene does not reach a level where the high viscosity polybutadiene clogs or otherwise adversely interferes with the manufacturing machinery. It is contemplated that polybutadiene with viscosity less than about 75 Mooney can be used with the present invention.

In one embodiment of the present invention, golf ball cores made with mid- to high-Mooney viscosity polybutadiene material exhibit increased resiliency (and, therefore, distance) without increasing the hardness of the ball.

Commercial sources of suitable mid- to high-Mooney viscosity polybutadiene include Lanxess Buna CB23 (Nd-catalyzed), which has a Mooney viscosity of around 50 and is a highly linear polybutadiene, and Dow SE BR-1220 (Co-catalyzed). If desired, the polybutadiene can also be mixed with other elastomers known in the art, such as other polybutadiene rubbers, natural rubber, styrene butadiene rubber, and/or isoprene rubber in order to further modify the properties of the core. When a mixture of elastomers is used, the amounts of other constituents in the core composition are typically based on 100 parts by weight of the total elastomer mixture.

In one preferred embodiment, the base rubber comprises a transition metal polybutadiene, a rare earth-catalyzed polybutadiene rubber, or blends thereof. If desired, the polybutadiene can also be mixed with other elastomers known in the art such as natural rubber, polyisoprene rubber and/or styrene-butadiene rubber in order to modify the properties of the core. Other suitable base rubbers include thermosetting materials such as, ethylene propylene diene monomer rubber, ethylene propylene rubber, butyl rubber, halobutyl rubber, hydrogenated nitrile butadiene rubber, nitrile rubber, and silicone rubber.

Thermoplastic elastomers (TPE) many also be used to modify the properties of the core layers, or the uncured core layer stock by blending with the base thermoset rubber. These TPEs include natural or synthetic balata, or high trans-polyisoprene, high trans-polybutadiene, or any styrenic block copolymer, such as styrene ethylene butadiene styrene, styrene-isoprene-styrene, etc., a metallocene or other single-site catalyzed polyolefin such as ethylene-octene, or ethylene-butene, or thermoplastic polyurethanes (TPU), including copolymers, e.g. with silicone. Other suitable TPEs for blending with the thermoset rubbers of the present invention include PEBAX®, which is believed to comprise polyether amide copolymers, HYTREL®, which is believed to comprise polyether ester copolymers, thermoplastic urethane, and KRATON®, which is believed to comprise styrenic block copolymers elastomers. Any of the TPEs or TPUs above may also contain functionality suitable for grafting, including maleic acid or maleic anhydride.

Additional polymers may also optionally be incorporated into the base rubber. Examples include, but are not limited to, thermoset elastomers such as core regrind, thermoplastic vulcanizate, copolymeric ionomer, terpolymeric ionomer, polycarbonate, polyamides, copolymeric polyamides, polyesters, polyvinyl alcohols, acrylonitrile-butadiene-styrene copolymers, polyarylate, polyacrylate, polyphenylene ether, impact-modified polyphenylene ether, high impact polystyrene, diallyl phthalate polymer, styrene-acrylonitrile polymer (SAN) (including olefin-modified SAN and acrylonitrile-styrene-acrylonitrile polymer), styrene-maleic anhydride copolymer, styrenic copolymer, functionalized styrenic copolymer, functionalized styrenic terpolymer, styrenic terpolymer, cellulose polymer, liquid crystal polymer, ethylene-vinyl acetate copolymers, polyurea, and polysiloxane or any metallocene-catalyzed polymers of these species.

Suitable polyamides for use as an additional polymeric material in compositions within the scope of the present invention also include resins obtained by: (1) polycondensation of (a) a dicarboxylic acid, such as oxalic acid, adipic acid, sebacic acid, terephthalic acid, isophthalic acid, or 1,4-cyclohexanedicarboxylic acid, with (b) a diamine, such as ethylenediamine, tetramethylenediamine, pentamethylenediamine, hexamethylenediamine, or decamethylenediamine, 1,4-cyclohexanediamine, or m-xylylenediamine; (2) a ring-opening polymerization of cyclic lactam, such as ϵ-caprolactam or Ω-laurolactam; (3) polycondensation of an aminocarboxylic acid, such as 6-aminocaproic acid, 9-aminononanoic acid, 11-aminoundecanoic acid, or 12-aminododecanoic acid; or (4) copolymerization of a cyclic lactam with a dicarboxylic acid and a diamine. Specific examples of suitable polyamides include NYLON 6, NYLON 66, NYLON 610, NYLON 11, NYLON 12, copolymerized NYLON, NYLON MXD6, and NYLON 46.

Suitable peroxide initiating agents include dicumyl peroxide; 2,5-dimethyl-2,5-di(t-butylperoxy)hexane; 2,5-dimethyl-2,5-di(t-butylperoxy)hexyne; 2,5-dimethyl-2,5-di(benzoylperoxy)hexane; 2,2-bis(t-butylperoxy)-di-isopropylbenzene; 1,1-bis(t-butylperoxy)-3,3,5-trimethyl cyclohexane; n-butyl 4,4-bis(t-butyl-peroxy)valerate; t-butyl perbenzoate; benzoyl peroxide; n-butyl 4,4'-bis(butylperoxy)valerate; di-t-butyl peroxide; or 2,5-di-(t-butylperoxy)-2,5-dimethyl hexane, lauryl peroxide, t-butyl hydroperoxide, α-αbis(t-butylperoxy)diisopropylbenzene, di(2-t-butyl-peroxyisopropyl)benzene, di-t-amyl peroxide, di-t-butyl peroxide. Commercially-available peroxide initiating agents include DICUP™ family of dicumyl peroxides (including DICUP™ R, DICUP™ 40C and DICUP™ 40KE) available from Crompton (Geo Specialty Chemicals). Similar initiating agents are available from AkroChem, Lanxess, Flexsys/Harwick and R.T. Vanderbilt. Another commercially-available and preferred initiating agent is TRIGONOX™ 265-50B from Akzo Nobel, which is a mixture of 1,1-di(t-butylperoxy)-3,3,5-trimethylcyclohexane and di(2-t-butylperoxyisopropyl)benzene. TRIGONOX™ peroxides are generally sold on a carrier compound. Additionally or alternatively, VAROX ANS may be used. Herein, the terms "peroxide initiating agents", peroxide(s), initiating agent(s) and initiator(s) are used interchangeably.

Suitable reactive co-agents include, but are not limited to, metal salts of diacrylates, dimethacrylates, and monomethacrylates suitable for use in this invention include those wherein the metal is zinc, magnesium, calcium, barium, tin, aluminum, lithium, sodium, potassium, iron, zirconium, and bismuth. Zinc diacrylate (ZDA) is preferred, but the present invention is not limited thereto. ZDA provides golf balls with a high initial velocity. The ZDA can be of various grades of purity. For the purposes of this invention, the lower the quantity of zinc stearate present in the ZDA the higher the ZDA purity. ZDA containing less than about 20% zinc stearate is preferable. More preferable is ZDA containing about 4-8% zinc stearate. Suitable, commercially available zinc diacrylates include those from Sartomer Co. The ZDA amount can be varied to suit the desired compression, spin and feel of the resulting golf ball.

Additional preferred co-agents that may be used alone or in combination with those mentioned above include, but are not limited to, trimethylolpropane trimethacrylate, trimethylolpropane triacrylate, and the like. It is understood by those skilled in the art, that in the case where these co-agents may be liquids at room temperature, it may be advantageous to disperse these compounds on a suitable carrier to promote ease of incorporation in the rubber mixture.

Antioxidants are compounds that inhibit or prevent the oxidative breakdown of elastomers, and/or inhibit or prevent reactions that are promoted by oxygen radicals. Some exemplary antioxidants that may be used in the present invention include, but are not limited to, quinoline type antioxidants, amine type antioxidants, and phenolic type antioxidants. A preferred antioxidant is 2,2'-methylene-bis-(4-methyl-6-t-butylphenol) available as VANOX® MBPC from R.T. Vanderbilt. Other polyphenolic antioxidants include VANOX® T, VANOX® L, VANOX® SKT, VANOX® SWP, VANOX® 13 and VANOX® 1290.

Suitable antioxidants include, but are not limited to, alkylene-bis-alkyl substituted cresols, such as 4,4'-methylene-bis(2,5-xylenol); 4,4'-ethylidene-bis-(6-ethyl-m-cresol); 4,4'-butylidene-bis-(6-t-butyl-m-cresol); 4,4'-decylidene-bis-(6-methyl-m-cresol); 4,4'-methylene-bis-(2-amyl-m-cresol); 4,4'-propylidene-bis-(5-hexyl-m-cresol); 3,3'-decylidene-bis-(5-ethyl-p-cresol); 2,2'-butylidene-bis-(3-n-hexyl-p-cresol); 4,4'-(2-butylidene)-bis-(6-t-butyl-m-cresol); 3,3'-4(decylidene)-bis-(5-ethyl-p-cresol); (2,5-dimethyl-4-hydroxyphenyl)(2-hydroxy-3,5-dimethylphenyl)methane; (2-methyl-4-hydroxy-5-ethylphenyl)(2-ethyl-3-hydroxy-5-methylphenyl)methane; (3-methyl-5-hydroxy-6-t-butylphenyl)(2-hydroxy-4-methyl-5-decylphenyl)-n-butyl methane; (2-hydroxy-4-ethyl-5-methylphenyl)(2-decyl-3-hydroxy-4-methylphenyl) butylamylmethane; (3-ethyl-4-methyl-5-hydroxyphenyl)-(2,3-dimethyl-3-hydroxy-phenyl)nonylmethane; (3-methyl-2-hydroxy-6-ethylphenyl)-(2-isopropyl-3-hydroxy-5-methylphenyl)cyclohexylmethane; (2-methyl-4-hydroxy-5-methylphenyl)(2-hydroxy-3-methyl-5-ethylphenyl) dicyclohexyl methane; and the like.

Other suitable antioxidants include, but are not limited to, substituted phenols, such as 2-tert-butyl-4-methoxyphenol; 3-tert-butyl-4-methoxyphenol; 3-tert-octyl-4-methoxyphenol; 2-methyl-4-methoxyphenol; 2-stearyl-4-n-butoxyphenol; 3-t-butyl-4-stearyloxyphenol; 3-lauryl-4-ethoxyphenol; 2,5-di-t-butyl-4-methoxyphenol; 2-methyl-4-methoxyphenol; 2-(1-methycyclohexyl)-4-methoxyphenol; 2-t-butyl-4-dodecyloxyphenol; 2-(1-methylbenzyl)-4-methoxyphenol; 2-t-octyl-4-methoxyphenol; methyl gallate; n-propyl gallate; n-butyl gallate; lauryl gallate; myristyl gallate; stearyl gallate; 2,4,5-trihydroxyacetophenone; 2,4,5-trihydroxy-n-butyrophenone; 2,4,5-trihydroxystearophenone; 2,6-ditert-butyl-4-methylphenol; 2,6-ditert-octyl-4-methylphenol; 2,6-ditert-butyl-4-stearylphenol; 2-methyl-4-methyl-6-tert-butylphenol; 2,6-distearyl-4-methylphenol; 2,6-dilauryl-4-methylphenol; 2,6-di(n-octyl)-4-methylphenol; 2,6-di(n-hexadecyl)-4-methylphenol; 2,6-di(1-methylundecyl)-4-methylphenol; 2,6-di(1-methylheptadecyl)-4-methylphenol; 2,6-di(trimethylhexyl)-4-methylphenol; 2,6-di(1,1,3,3-tetramethyloctyl)-4-methylphenol; 2-n-dodecyl-6-tert butyl-4-methylphenol; 2-n-dodecyl-6-(1-methylundecyl)-4-methylphenol; 2-n-dodecyl-6-(1,1,3,3-tetramethyloctyl)-4-methylphenol; 2-n-dodecyl-6-n-octadecyl-4-methylphenol; 2-n-dodecyl-6-n-octyl-4-methylphenol; 2-methyl-6-n-octadecyl-4-methylphenol; 2-n-dodecyl-6-(1-methylheptadecyl)-4-methylphenol; 2,6-di(1-methylbenzyl)-4-methylphenol; 2,6-di(1-methylcyclohexyl)-4-methylphenol; 2,6-(1-methylcyclohexyl)-4-methylphenol; 2-(1-methylbenzyl)-4-methylphenol; and related substituted phenols.

More suitable antioxidants include, but are not limited to, alkylene bisphenols, such as 4,4'-butylidene bis(3-methyl-6-t-butyl phenol); 2,2-butylidene bis(4,6-dimethyl phenol); 2,2'-butylidene bis(4-methyl-6-t-butyl phenol); 2,2'-butylidene bis(4-t-butyl-6-methyl phenol); 2,2'-ethylidene bis(4-methyl-6-t-butylphenol); 2,2'-methylene bis(4,6-dimethyl phenol); 2,2'-methylene bis(4-methyl-6-t-butyl phenol); 2,2'-methylene bis(4-ethyl-6-t-butyl phenol); 4,4'-methylene bis(2,6-di-t-butyl phenol); 4,4'-methylene bis(2-methyl-6-t-butyl phenol); 4,4'-methylene bis(2,6-dimethyl phenol); 2,2'-methylene bis(4-t-butyl-6-phenyl phenol); 2,2'-dihydroxy-3,3',5,5'-tetramethylstilbene; 2,2'-isopropylidene bis (4-methyl-6-t-butyl phenol); ethylene bis(beta-naphthol); 1,5-dihydroxy naphthalene; 2,2'-ethylene bis(4-methyl-6-propyl phenol); 4,4'-methylene bis(2-propyl-6-t-butyl phenol); 4,4'-ethylene bis(2-methyl-6-propyl phenol); 2,2'-methylene bis(5-methyl-6-t-butyl phenol); and 4,4'-butylidene bis(6-t-butyl-3-methyl phenol).

Suitable antioxidants further include, but are not limited to, alkylene trisphenols, such as 2,6-bis(2'-hydroxy-3'-t-butyl-5'-methyl benzyl)-4-methyl phenol; 2,6-bis(2'-hydroxy-3'-t-ethyl-5'-butyl benzyl)-4-methyl phenol; and 2,6-bis(2'-hydroxy-3'-t-butyl-5'-propyl benzyl)-4-methyl phenol.

The thermoset rubber composition of the present invention may also include an optional soft and fast agent. As used herein, "soft and fast agent" means any compound or a blend thereof that that is capable of making a core 1) be softer (lower compression) at constant COR or 2) have a higher COR at equal compression, or any combination thereof, when compared to a core equivalently prepared without a soft and fast agent.

Suitable soft and fast agents include, but are not limited to, organosulfur or metal-containing organosulfur compounds, an organic sulfur compound, including mono, di, and polysulfides, a thiol, or mercapto compound, an inorganic sulfide compound, a Group VIA compound, or mixtures thereof. The soft and fast agent component may also be a blend of an organosulfur compound and an inorganic sulfide compound.

Suitable soft and fast agents of the present invention include, but are not limited to those having the following general formula:

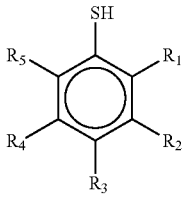

where $R_1$-$R_5$ can be $C_1$-$C_8$ alkyl groups; halogen groups; thiol groups (—SH), carboxylated groups; sulfonated groups; and hydrogen; in any order; and also pentafluorothiophenol; 2-fluorothiophenol; 3-fluorothiophenol; 4-fluorothiophenol; 2,3-fluorothiophenol; 2,4-fluorothiophenol; 3,4-fluorothiophenol; 3,5-fluorothiophenol 2,3,4-fluorothiophenol; 3,4,5-fluorothiophenol; 2,3,4,5-tetrafluorothiophenol; 2,3,5,6-tetrafluorothiophenol; 4-chlorotetrafluorothiophenol; pentachlorothiophenol; 2-chlorothiophenol; 3-chlorothiophenol; 4-chlorothiophenol; 2,3-chlorothiophenol; 2,4-chlorothiophenol; 3,4-chlorothiophenol; 3,5-chlorothiophenol; 2,3,4-chlorothiophenol; 3,4,5-chlorothiophenol; 2,3,4,5-tetrachlorothiophenol; 2,3,5,6-tetrachlorothiophenol; pentabromothiophenol; 2-bromothiophenol; 3-bromothiophenol; 4-bromothiophenol; 2,3-bromothiophenol; 2,4-bromothiophenol; 3,4-bromothiophenol; 3,5-bromothiophenol; 2,3,4-bromothiophenol; 3,4,5-bromothiophenol; 2,3,4,5-tetrabromothiophenol; 2,3,5,6-tetrabromothiophenol; pentaiodothiophenol; 2-iodothiophenol; 3-iodothiophenol; 4-iodothiophenol; 2,3-iodothiophenol; 2,4-iodothiophenol; 3,4-iodothiophenol; 3,5-iodothiophenol; 2,3,4-iodothiophenol; 3,4,5-iodothiophenol; 2,3,4,5-tetraiodothiophenol; 2,3,5,6-tetraiodothiophenol and; and their zinc salts. Preferably, the halogenated thiophenol compound is pentachlorothiophenol, which is commercially available in neat form or under the tradename STRUKTOL®, a clay-based carrier containing the sulfur compound pentachlorothiophenol loaded at 45 percent (correlating to 2.4 parts PCTP). STRUKTOL® is commercially available from Struktol Company of America of Stow, Ohio. PCTP is commercially available in neat form from eChinachem of San Francisco, Calif. and in the salt form from eChinachem of San Francisco, Calif. Most preferably, the halogenated thiophenol compound is the zinc salt of pentachlorothiophenol, which is commercially available from eChinachem of San Francisco, Calif.

As used herein when referring to the invention, the term "organosulfur compound(s)" refers to any compound containing carbon, hydrogen, and sulfur, where the sulfur is directly bonded to at least 1 carbon. As used herein, the term "sulfur compound" means a compound that is elemental sulfur, polymeric sulfur, or a combination thereof. It should be further understood that the term "elemental sulfur" refers to the ring structure of $S_8$ and that "polymeric sulfur" is a structure including at least one additional sulfur relative to elemental sulfur.

Additional suitable examples of soft and fast agents (that are also believed to be cis-to-trans catalysts) include, but are not limited to, 4,4'-diphenyl disulfide; 4,4'-ditolyl disulfide; 2,2'-benzamido diphenyl disulfide; bis(2-aminophenyl)disulfide; bis(4-aminophenyl)disulfide; bis(3-aminophenyl)disulfide; 2,2'-bis(4-aminonaphthyl)disulfide; 2,2'-bis(3-aminonaphthyl)disulfide; 2,2'-bis(4-aminonaphthyl)disulfide; 2,2'-bis(5-aminonaphthyl)disulfide; 2,2'-bis(6-aminonaphthyl)disulfide; 2,2'-bis(7-aminonaphthyl)disulfide; 2,2'-bis (8-aminonaphthyl) disulfide; 1,1'-bis(2-aminonaphthyl)disulfide; 1,1'-bis(3-aminonaphthyl)disulfide; 1,1'-bis(3-aminonaphthyl)disulfide; 1,1'-bis(4-aminonaphthyl) disulfide; 1,1'-bis(5-aminonaphthyl) disulfide; 1,1'-bis(6-aminonaphthyl)disulfide; 1,1'-bis(7-aminonaphthyl) disulfide; 1,1'-bis(8-aminonaphthyl)disulfide; 1,2'-diamino-1,2'-dithiodinaphthalene; 2,3'-diamino-1,2'-dithiodinaphthalene; bis(4-chlorophenyl)disulfide; bis(2-chlorophenyl)disulfide; bis(3-chlorophenyl)disulfide; bis(4-bromophenyl)disulfide; bis(2-bromophenyl)disulfide; bis(3-bromophenyl)disulfide; bis(4-fluorophenyl)disulfide; bis(4-iodophenyl)disulfide; bis(2,5-dichlorophenyl)disulfide; bis (3,5-dichlorophenyl)disulfide; bis(2,4-dichlorophenyl) disulfide; bis(2,6-dichlorophenyl)disulfide; bis(2,5-dibromophenyl)disulfide; bis(3,5-dibromophenyl)disulfide; bis(2-chloro-5-bromophenyl)disulfide; bis(2,4,6-trichlorophenyl)disulfide; bis(2,3,4,5,6-pentachlorophenyl)disulfide; bis(4-cyanophenyl)disulfide; bis(2-cyanophenyl)disulfide; bis(4-nitrophenyl)disulfide; bis(2-nitrophenyl)disulfide; 2,2'-dithiobenzoic acid ethylester; 2,2'-dithiobenzoic acid methylester; 2,2'-dithiobenzoic acid; 4,4'-dithiobenzoic acid ethylester; bis(4-acetylphenyl)disulfide; bis(2-acetylphenyl) disulfide; bis(4-formylphenyl)disulfide; bis(4-carbamoyl-phenyl)disulfide; 1,1'-dinaphthyl disulfide; 2,2'-dinaphthyl disulfide; 1,2'-dinaphthyl disulfide; 2,2'-bis(1-chlorodinaphthyl)disulfide; 2,2'-bis(1-bromonaphthyl) disulfide; 1,1'-bis (2-chloronaphthyl)disulfide; 2,2'-bis(1-cyanonaphthyl)disulfide; 2,2'-bis(1-acetylnaphthyl)disulfide; and the like; or a mixture thereof. Preferred organosulfur components include 4,4'-diphenyl disulfide, 4,4'-ditolyl disulfide, or 2,2'-benzamido diphenyl disulfide, or a mixture thereof. A more preferred organosulfur component includes 4,4'-ditolyl disulfide. In another embodiment, metal-containing organosulfur components can be used according to the invention. Suitable metal-containing organosulfur components include, but are not limited to, cadmium, copper, lead, and tellurium analogs of diethyldithiocarbamate, diamyldithiocarbamate, and dimethyldithiocarbamate, or mixtures thereof.

Suitable substituted or unsubstituted aromatic organic components that do not include sulfur or a metal include, but are not limited to, 4,4'-diphenyl acetylene, azobenzene, or a mixture thereof. The aromatic organic group preferably ranges in size from $C_6$ to $C_{20}$, and more preferably from $C_6$ to $C_{10}$. Suitable inorganic sulfide components include, but are not limited to titanium sulfide, manganese sulfide, and sulfide analogs of iron, calcium, cobalt, molybdenum, tungsten, copper, selenium, yttrium, zinc, tin, and bismuth.

A substituted or unsubstituted aromatic organic compound is also suitable as a soft and fast agent. Suitable substituted or unsubstituted aromatic organic components include, but are not limited to, components having the formula $(R_1)_x$—$R_3$-M-$R_4$—$(R_2)_y$, wherein $R_1$ and $R_2$ are each hydrogen or a substituted or unsubstituted $C_{1-20}$ linear, branched, or cyclic alkyl, alkoxy, or alkylthio group, or a single, multiple, or fused ring $C_6$ to $C_{24}$ aromatic group; x and y are each an integer from 0 to 5; $R_3$ and $R_4$ are each selected from a single, multiple, or fused ring $C_6$ to $C_{24}$ aromatic group; and M includes an azo group or a metal component. $R_3$ and $R_4$ are each preferably selected from a $C_6$ to $C_{10}$ aromatic group, more preferably selected from phenyl, benzyl, naphthyl, benzamido, and benzothiazyl. $R_1$ and $R_2$ are each preferably selected from a substituted or unsubstituted $C_{1-10}$ linear, branched, or cyclic alkyl, alkoxy, or alkylthio group or a $C_6$ to $C_{10}$ aromatic group. When $R_1$, $R_2$, $R_3$, or $R_4$, are substituted, the substitution may include one or more of the following substituent groups: hydroxy and metal salts thereof; mercapto and metal salts thereof; halogen; amino, nitro, cyano, and amido; carboxyl including esters, acids, and metal salts thereof; silyl; acrylates and metal salts thereof; sulfonyl or sulfonamide; and phosphates and phosphites. When M is a metal component, it may be any suitable elemental metal available to those of ordinary skill in the art. Typically, the metal will be a transition metal, although preferably it is tellurium or selenium. In one embodiment, the aromatic organic compound is substantially free of metal, while in another embodiment the aromatic organic compound is completely free of metal.

The soft and fast agent can also include a Group VIA component. Elemental sulfur and polymeric sulfur are commercially available from Elastochem, Inc. of Chardon, Ohio. Exemplary sulfur catalyst compounds include PB(RM-S)-80 elemental sulfur and PB(CRST)-65 polymeric sulfur, each of which is available from Elastochem, Inc. An exemplary tellurium catalyst under the tradename TELLOY® and an exemplary selenium catalyst under the tradename VANDEX® are each commercially available from RT Vanderbilt.

Other suitable soft and fast agents include, but are not limited to, hydroquinones, benzoquinones, quinhydrones, catechols, and resorcinols.

Suitable hydroquinone compounds include compounds represented by the following formula, and hydrates thereof:

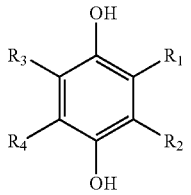

wherein each $R_1$, $R_2$, $R_3$, and $R_4$ are hydrogen; halogen; alkyl; carboxyl; metal salts thereof, and esters thereof; acetate and esters thereof; formyl; acyl; acetyl; halogenated carbonyl; sulfo and esters thereof; halogenated sulfonyl; sulfino; alkylsulfinyl; carbamoyl; halogenated alkyl; cyano; alkoxy; hydroxy and metal salts thereof; amino; nitro; aryl; aryloxy; arylalkyl; nitroso; acetamido; or vinyl.

Other suitable hydroquinone compounds include, but are not limited to, hydroquionone; tetrachlorohydroquinone; 2-chlorohydroquionone; 2-bromohydroquinone; 2,5-dichlorohydroquinone; 2,5-dibromohydroquinone; tetrabromohydroquinone; 2-methylhydroquinone; 2-t-butylhydroquinone; 2,5-di-t-amylhydroquinone; and 2-(2-chlorophenyl) hydroquinone hydrate.

More suitable hydroquinone compounds include compounds represented by the following formula, and hydrates thereof:

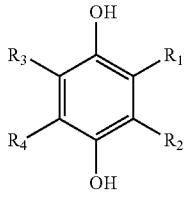

wherein each $R_1$, $R_2$, $R_3$, and $R_4$ are a metal salt of a carboxyl; acetate and esters thereof; hydroxy; a metal salt of a hydroxy; amino; nitro; aryl; aryloxy; arylalkyl; nitroso; acetamido; or vinyl.

Suitable benzoquinone compounds include compounds represented by the following formula, and hydrates thereof:

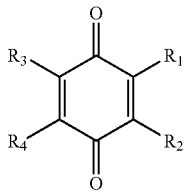

wherein each $R_1$, $R_2$, $R_3$, and $R_4$ are hydrogen; halogen; alkyl; carboxyl; metal salts thereof, and esters thereof; acetate and esters thereof; formyl; acyl; acetyl; halogenated carbonyl; sulfo and esters thereof; halogenated sulfonyl; sulfino; alkylsulfinyl; carbamoyl; halogenated alkyl; cyano; alkoxy; hydroxy and metal salts thereof; amino; nitro; aryl; aryloxy; arylalkyl; nitroso; acetamido; or vinyl.

Other suitable benzoquinone compounds include one or more compounds represented by the following formula, and hydrates thereof:

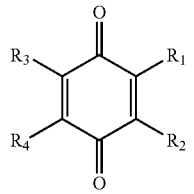

wherein each $R_1$, $R_2$, $R_3$, and $R_4$ are a metal salt of a carboxyl; acetate and esters thereof; hydroxy; a metal salt of a hydroxy; amino; nitro; aryl; aryloxy; arylalkyl; nitroso; acetamido; or vinyl.

Suitable quinhydrones include one or more compounds represented by the following formula, and hydrates thereof:

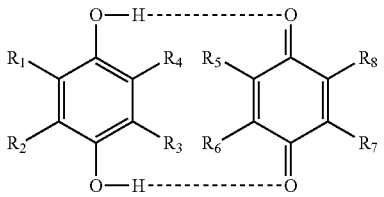

wherein each $R_1$, $R_2$, $R_3$, $R_4$, $R_5$, $R_6$, $R_7$, and $R_8$ are hydrogen; halogen; alkyl; carboxyl; metal salts thereof, and esters thereof; acetate and esters thereof; formyl; acyl; acetyl; halogenated carbonyl; sulfo and esters thereof; halogenated sulfonyl; sulfino; alkylsulfinyl; carbamoyl; halogenated alkyl; cyano; alkoxy; hydroxy and metal salts thereof; amino; nitro; aryl; aryloxy; arylalkyl; nitroso; acetamido; or vinyl.

Other suitable quinhydrones include those having the above formula, wherein each $R_1$, $R_2$, $R_3$, $R_4$, $R_5$, $R_6$, $R_7$, and $R_8$ are a metal salt of a carboxyl; acetate and esters thereof; hydroxy; a metal salt of a hydroxy; amino; nitro; aryl; aryloxy; arylalkyl; nitroso; acetamido; or vinyl.

Suitable catechols include one or more compounds represented by the following formula, and hydrates thereof:

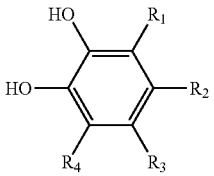

wherein each $R_1$, $R_2$, $R_3$, and $R_4$ are hydrogen; halogen; alkyl; carboxyl; metal salts thereof, and esters thereof; acetate and esters thereof; formyl; acyl; acetyl; halogenated carbonyl; sulfo and esters thereof; halogenated sulfonyl; sulfino; alkylsulfinyl; carbamoyl; halogenated alkyl; cyano; alkoxy; hydroxy and metal salts thereof; amino; nitro; aryl; aryloxy; arylalkyl; nitroso; acetamido; or vinyl.

Suitable resorcinols include one or more compounds represented by the following formula, and hydrates thereof:

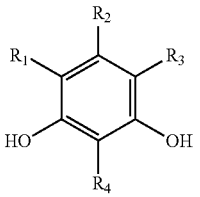

wherein each $R_1$, $R_2$, $R_3$, and $R_4$ are hydrogen; halogen; alkyl; carboxyl; metal salts thereof, and esters thereof; acetate and esters thereof; formyl; acyl; acetyl; halogenated carbonyl; sulfo and esters thereof; halogenated sulfonyl; sulfino; alkylsulfinyl; carbamoyl; halogenated alkyl; cyano; alkoxy; hydroxy and metal salts thereof; amino; nitro; aryl; aryloxy; arylalkyl; nitroso; acetamido; or vinyl.

Fillers may also be added to the thermoset rubber composition of the core to adjust the density of the composition, up or down. Typically, fillers include materials such as tungsten, zinc oxide, barium sulfate, silica, calcium carbonate, zinc carbonate, metals, metal oxides and salts, regrind (recycled core material typically ground to about 30 mesh particle), high-Mooney-viscosity rubber regrind, trans-regrind core material (recycled core material containing high trans-isomer of polybutadiene), and the like. When trans-regrind is present, the amount of trans-isomer is preferably between about 10% and about 60%. In a preferred embodiment of the invention, the core comprises polybutadiene having a cis-isomer content of greater than about 95% and trans-regrind core material (already vulcanized) as a filler. Any particle size trans-regrind core material is sufficient, but is preferably less than about 125 μm.

Fillers added to one or more portions of the golf ball typically include processing aids or compounds to affect rheological and mixing properties, density-modifying fillers, tear strength, or reinforcement fillers, and the like. The fillers are generally inorganic, and suitable fillers include numerous metals or metal oxides, such as zinc oxide and tin oxide, as well as barium sulfate, zinc sulfate, calcium carbonate, barium carbonate, clay, tungsten, tungsten carbide, an array of silicas, and mixtures thereof. Fillers may also include various foaming agents or blowing agents which may be readily selected by one of ordinary skill in the art. Fillers may include polymeric, ceramic, metal, and glass microspheres may be solid or hollow, and filled or unfilled. Fillers are typically also added to one or more portions of the golf ball to modify the density thereof to conform to uniform golf ball standards. Fillers may also be used to modify the weight of the center or at least one additional layer for specialty balls, e.g., a lower weight ball is preferred for a player having a low swing speed.

Materials such as tungsten, zinc oxide, barium sulfate, silica, calcium carbonate, zinc carbonate, metals, metal oxides and salts, and regrind (recycled core material typically ground to about 30 mesh particle) are also suitable fillers.

The polybutadiene and/or any other base rubber or elastomer system may also be foamed, or filled with hollow microspheres or with expandable microspheres which expand at a set temperature during the curing process to any low specific gravity level. Other ingredients such as sulfur accelerators, e.g., tetra methylthiuram di, tri, or tetrasulfide, and/or metal-containing organosulfur components may also be used according to the invention. Suitable metal-containing organosulfur accelerators include, but are not limited to, cadmium, copper, lead, and tellurium analogs of diethyldithiocarbamate, diamyldithiocarbamate, and dimethyldithiocarbamate, or mixtures thereof. Other ingredients such as processing aids e.g., fatty acids and/or their metal salts, processing oils, dyes and pigments, as well as other additives known to one skilled in the art may also be used in the present invention in amounts sufficient to achieve the purpose for which they are typically used.

The ratio of antioxidant to initiator and the cure cycle temperatures and durations are some factors which control the surface hardness of each core layer and provide the inventive regions of varying hardness within each core layer.

Referring to FIG. 1, golf ball 10 in accordance with the present invention is constructed to provide the desired spin profile and playing characteristics. In an embodiment as illustrated, golf ball 10 includes core 16 having core layers 17 and 18 and cover layer 15 surrounding core 16. In one embodiment, the diameter of core 16 is greater than about 1.58 inches. Preferably, the diameter of core 16 is greater than about 1.6 inches. Core layers 17 and 18 represent the inner core layer and outer core layer, respectively, as disclosed and claimed herein.

Examples of suitable formulations for several embodiments of golf ball 10 as discussed in SECTION I are summarized in the following TABLE I:

TABLE I

| Components | Ranges Inner Core | | Ranges Outer Core | |
|---|---|---|---|---|
| (phr) | A | B | C | D |
| ZDA | 25-35 | 30-40 | 25-40 | 25-40 |
| ZnO | 5-10 | 5-10 | 5-10 | 5-10 |
| $BaSO_4$ | Vary to achieve targeted specific gravity | | | |
| VANOX MBPC* (Antioxidant) | 0-1.0 | 0-1.0 | 0.2-1.2 | 0 |
| TRIGONOX** | 0.5-1.0 | 0.5-1.2 | 0.5-1.2 | 0 |
| PERKADOX BC-FF*** | — | — | 0 | 0.5-1.5 |
| Polybutadiene | 100 | 100 | 85-100 | 85-100 |
| Trans polyisoprene | 0-15 | 0-15 | 0-15 | 0-15 |
| ZnPCTP | 0-3 | 0-3 | 0-3 | 0-3 |
| Regrind | 10-30 | 10-30 | 10-30 | 10-30 |
| antioxidant/ initiator ratio | 0-2.5 | 0-4.8 | 0.33-4.8 | — |
| Cure Temp. (° F.) | 325-350 | 290-315 | 100-150 | 100-150 |
| Cure Time $T_1$ (min) | 10-15 | 15-20 | 3-7 | 3-7 |
| Cure Temp. (° F.) | — | — | 290-315 | 330-350 |
| Cure Time $T_2$ (min) | — | — | 5-10 | 5-10 |
| Layer Diameter/ Thickness (in) | 0.75-1.25 | 0.75-1.25 | 0.14-0.415 | 0.14-0.415 |
| Atti compression | — | — | 75-100 | 75-100 |
| COR @ 125 ft/s | — | — | 0.795 | 0.795 |

The invention cores of the invention may also additional materials as disclosed herein.

Figure 2:
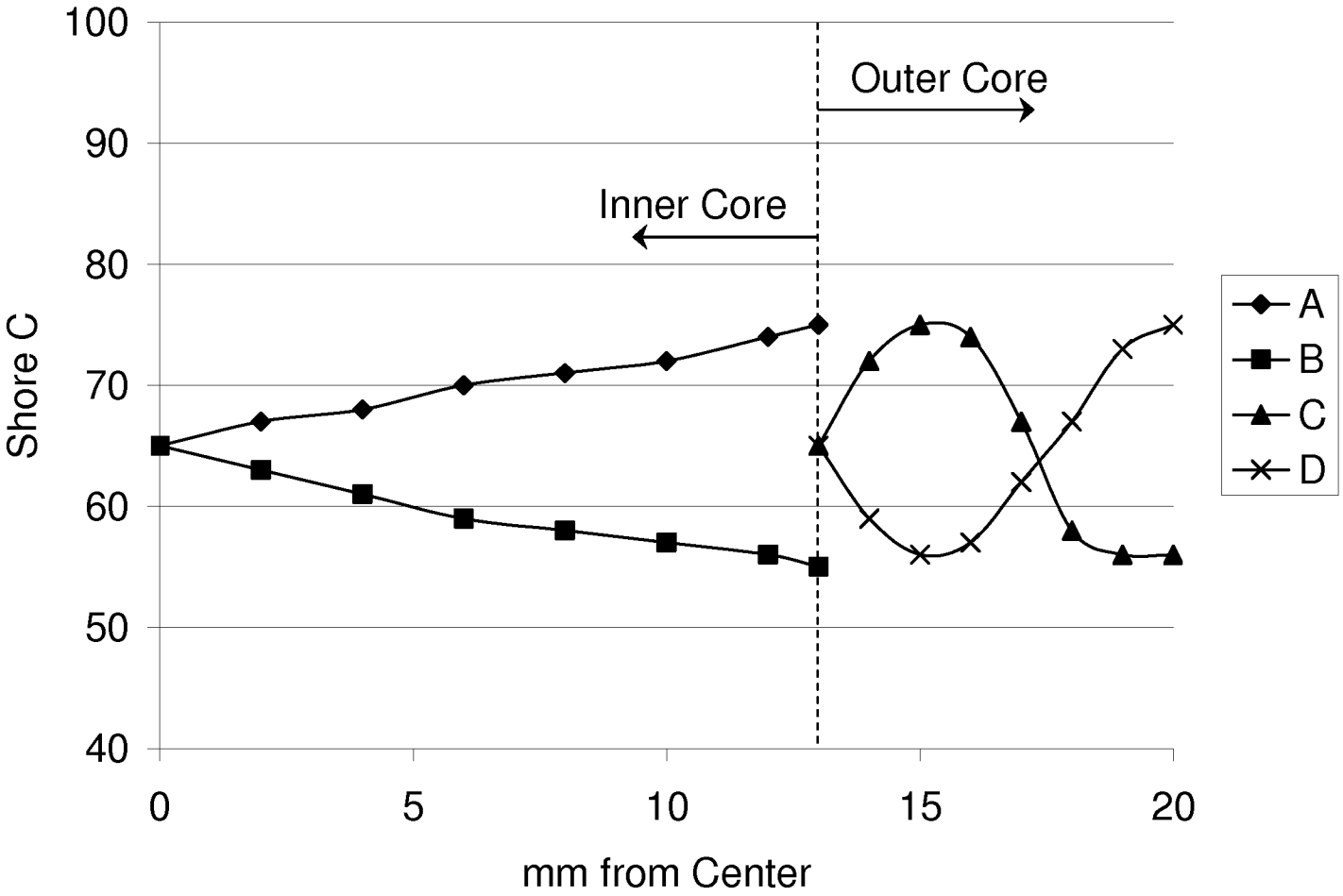
FIG. 2 is a graph of the Shore C hardness of an inventive multi-layer core as a function of the distance from its center according to illustrative embodiments.
Figure 3:
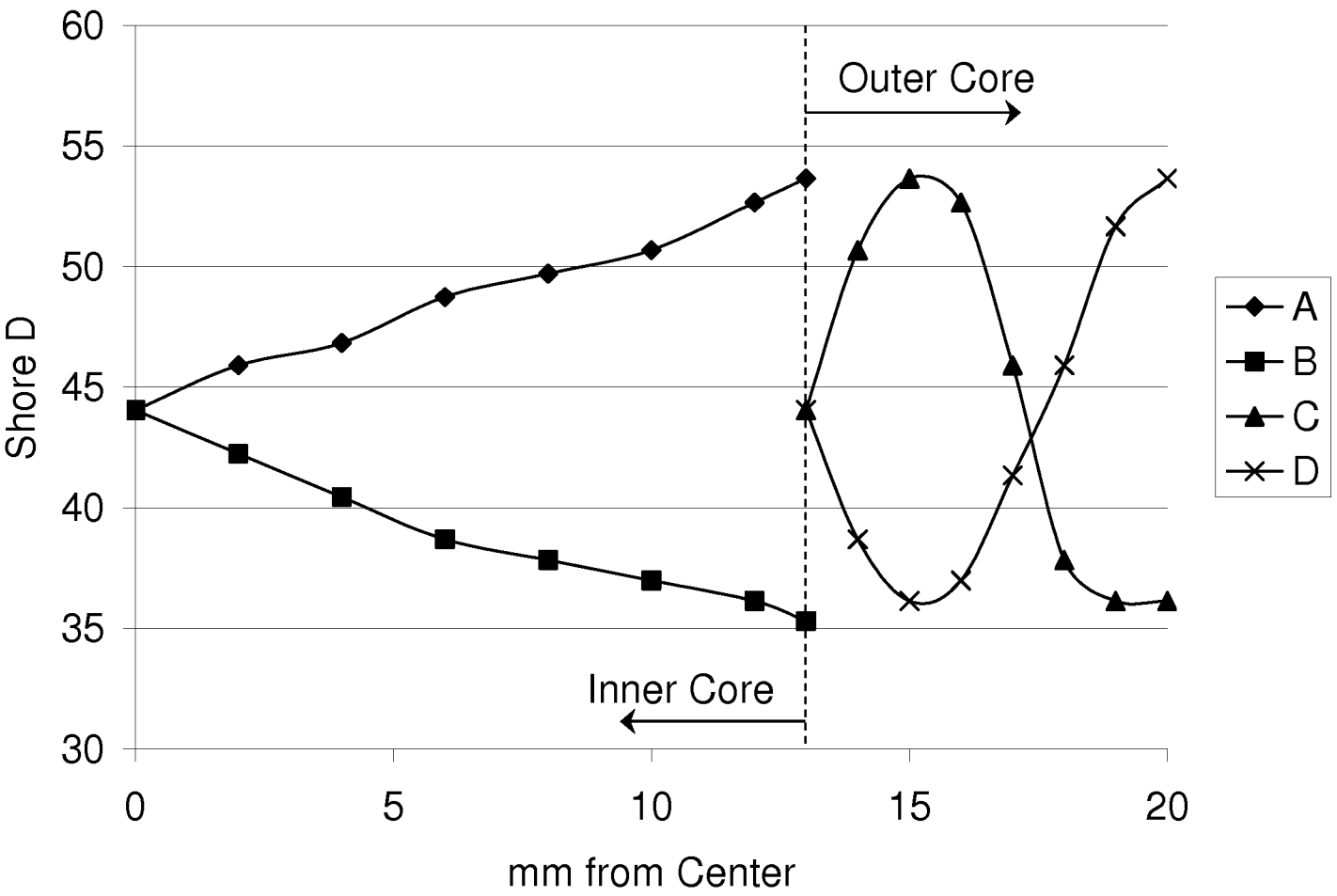
FIG. 3 is a graph of the Shore D hardness of an inventive multi-layer core as a function of the distance from its center according to illustrative embodiments.

FIGS. 2 and 3 illustrate several golf balls according to the invention. The inner core layer may have a hardness gradient represented by slope A, while the outer core layer meanwhile having a hardness gradient represented by either curve C or curve D. Alternatively, the inner core layer may a hardness gradient represented by slope B, the outer core layer meanwhile having a hardness gradient represented by either curve C or curve D. In each of these cases, the first hardness is located at the geometric center (0 mm from the center), the second and third hardnesses are located on the first outer surface and inner surface, respectively, about the vertical dotted line 10 mm to 15 mm from the geometric center. In FIGS. 2 and 3, the second and third hardnesses are different from each other. However, the second and third hardnesses may alternatively be substantially similar to each other. The fourth hardness is located about 20 mm from the geometric center in FIGS. 2 and 3. The fifth hardness appears between the third and fourth hardnesses in a region extending between about 10% and about 90% of the distance from the inner surface to the second outer surface. As discussed more fully throughout, each embodiment defines particular examples of possible hardness relationships between the first, second third, fourth and fifth hardnesses.

Examples of suitable formulations for several embodiments of golf ball 10 as discussed in SECTION II are summarized in the following TABLE II:

TABLE II

| Component | Ranges | Ranges Outer Core | |
|---|---|---|---|
| (phr) | Inner Core | A | B |
| ZDA | 35-45 | 39-45 | 35-42 |
| ZnO | 5-10 | 5-10 | 5-10 |
| $BaSO_4$ | Vary to achieve targeted specific gravity | | |
| VANOX MBPC* (Antioxidant) | 0 | 0.2-1.0 | 0.2-1.0 |
| TRIGONOX 265** | 0 | 0.8-1.5 | 0.6-1.2 |
| PERKADOX BC-FF*** | 0.6-1.2 | — | — |
| Polybutadiene | 100 | 85-100 | 85-100 |
| Trans polyisoprene | 0-15 | 0-15 | 0-15 |
| ZnPCTP | 0-3 | 0-3 | 0-3 |
| Regrind | 10-30 | 10-30 | 10-30 |
| antioxidant/ initiator ratio | — | 0.27-2.5 | 0.33-3.33 |
| Cure Temp. (° F.) | 340° F.-365° F. | 100° F.-150° F. | 100° F.-150° F. |
| Cure Time $T_1$ (min) | 10-15 | 2-7 | 2-7 |
| Cure Temp. (° F.) | — | 320° F.-330° F. | 300° F.-320° F. |
| Cure Time $T_2$ (min) | — | 10-15 | 15-20 |
| Layer Diameter/ Thickness (in) | 0.75-1.25 | 0.14-0.415 | 0.14-0.415 |
| Atti compression | — | 80-100 | 90-120 |
| COR @ 125 ft/s | — | 0.795-0.820 | 0.800-0.825 |

The inventive cores of the invention may also include additional materials as disclosed herein.

Figure 4:
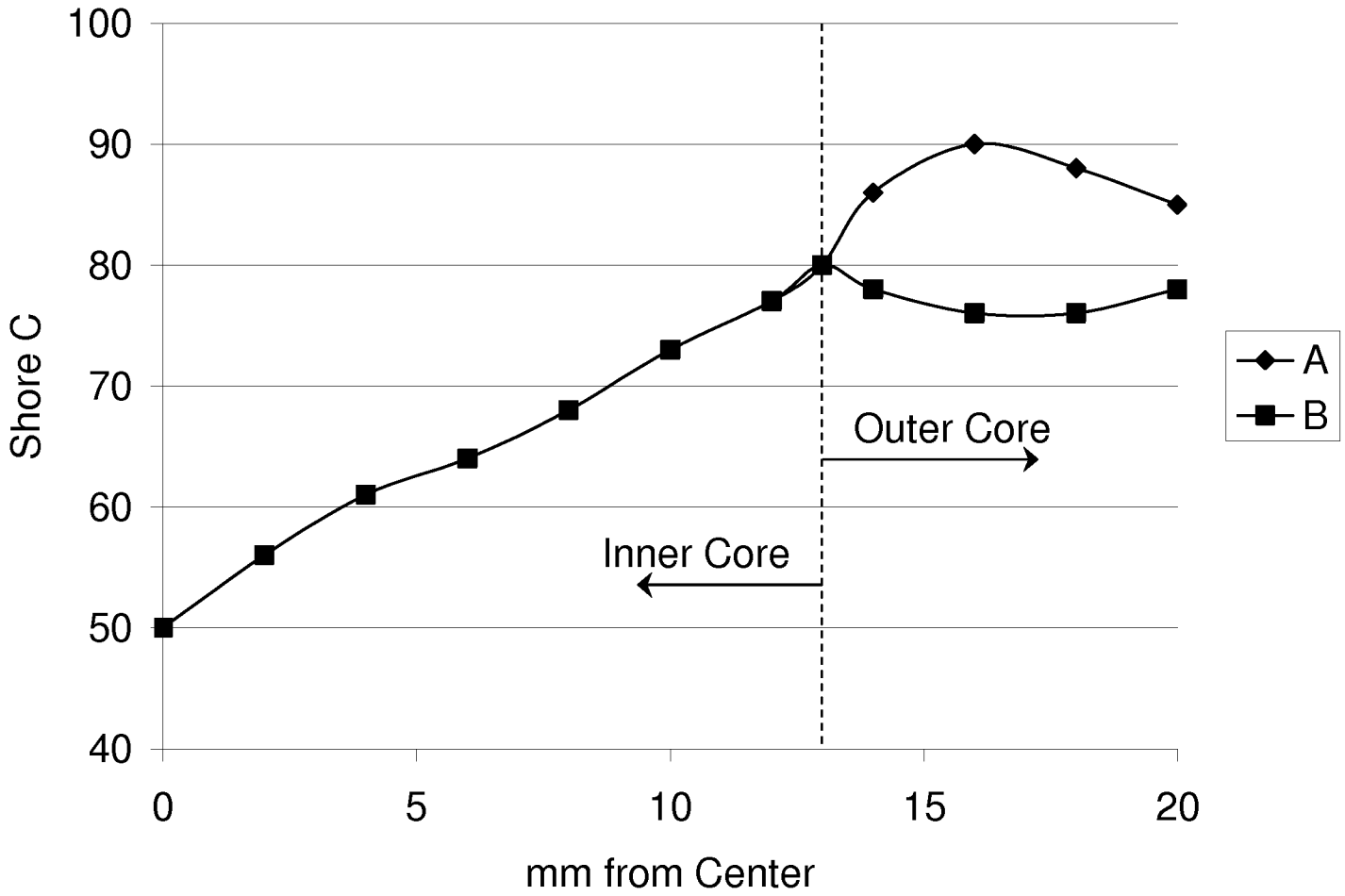
FIG. 4 is a graph of the Shore C hardness of an inventive multi-layer core as a function of the distance from its center according to illustrative embodiments.
Figure 5:
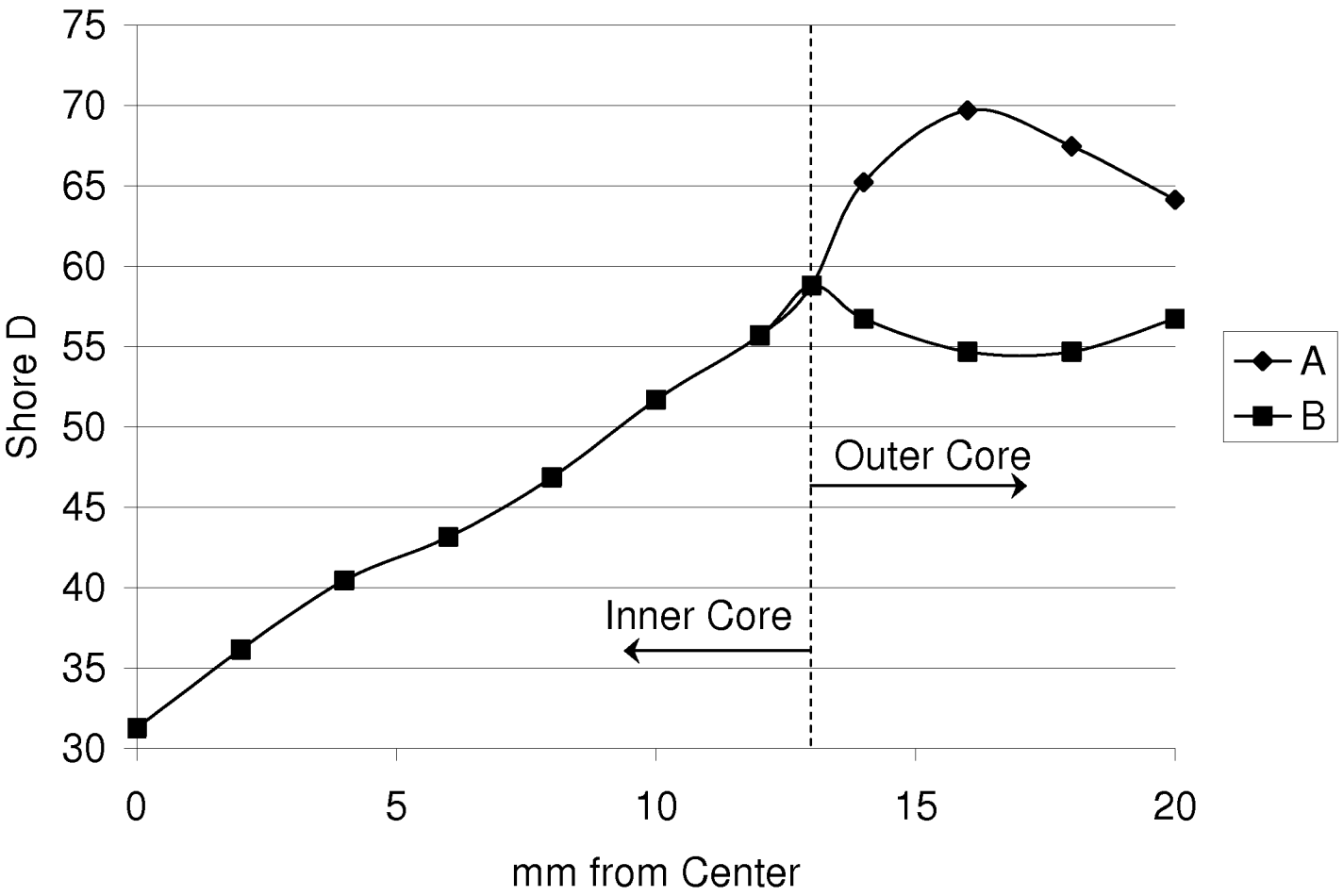
FIG. 5 is a graph of the Shore D hardness of an inventive multi-layer core as a function of the distance from its center according to illustrative embodiments.

FIGS. 4 and 5 illustrate several golf balls according to the invention. The inner core layer may have a hardness gradient represented by slope A, the outer core layer meanwhile having a hardness gradient represented by either curve B or curve C. In each of these cases, the first hardness is located at the geometric center (0 mm from the center), the second and third hardnesses are located on the first outer surface and inner surface, respectively, about the vertical dotted line 10 mm to 15 mm from the geometric center. In FIGS. 4 and 5, the second and third hardnesses are similar. The fourth hardness is located about 20 mm from the geometric center, and the fifth hardness appears between the third and fourth hardnesses in a region extending between about 10% and about 90% of the distance from the inner surface to the second outer surface. As discussed more fully throughout, each embodiment defines particular examples of possible hardness relationships between the first, second third, fourth and fifth hardnesses.

Examples of suitable formulations for several embodiments of golf ball 10 as discussed in SECTION III are summarized in the following table:

TABLE III

| Component | Ranges | Ranges Outer Core | |
|---|---|---|---|
| (phr) | Inner Core | A | B |
| ZDA | 35-45 | 39-45 | 35-42 |
| ZnO | 5-10 | 5-10 | 5-10 |
| $BaSO_4$ | Vary to achieve targeted specific gravity | | |
| VANOX MBPC* (Antioxidant) | 0-1.0 | 0.2-1.0 | 0.2-1.0 |
| TRIGONOX** | 0.5-1.0 | 0.8-1.5 | 0.6-1.2 |
| Polybutadiene | 100 | 85-100 | 85-100 |
| Trans polyisoprene | 0-15 | 0-15 | 0-15 |
| ZnPCTP | 0-3 | 0-3 | 0-3 |
| Regrind | 10-30 | 10-30 | 10-30 |

TABLE III-continued

| Component | Ranges | Ranges Outer Core | |
|---|---|---|---|
| (phr) | Inner Core | A | B |
| antioxidant/initiator ratio | 0-2.5 | 0.27-2.5 | 0.33-3.33 |
| Cure Temp. (° F.) | 325-250 | 100° F.-150° F. | 100° F.-150° F. |
| Cure Time $T_1$ (min) | 10-15 | 2-7 | 2-7 |
| Cure Temp. (° F.) | — | 320° F.-330° F. | 300° F.-320° F. |
| Cure Time $T_2$ (min) | — | 10-15 | 15-20 |
| Layer Diameter/ Thickness (in) | 0.75-1.25 | 0.14-0.415 | 0.14-0.415 |
| Atti compression | — | 80-100 | 90-120 |
| COR @ 125 ft/s | — | 0.795-0.820 | 0.800-0.825 |

The inventive cores of the invention may also include additional materials as disclosed herein.

Figure 6:
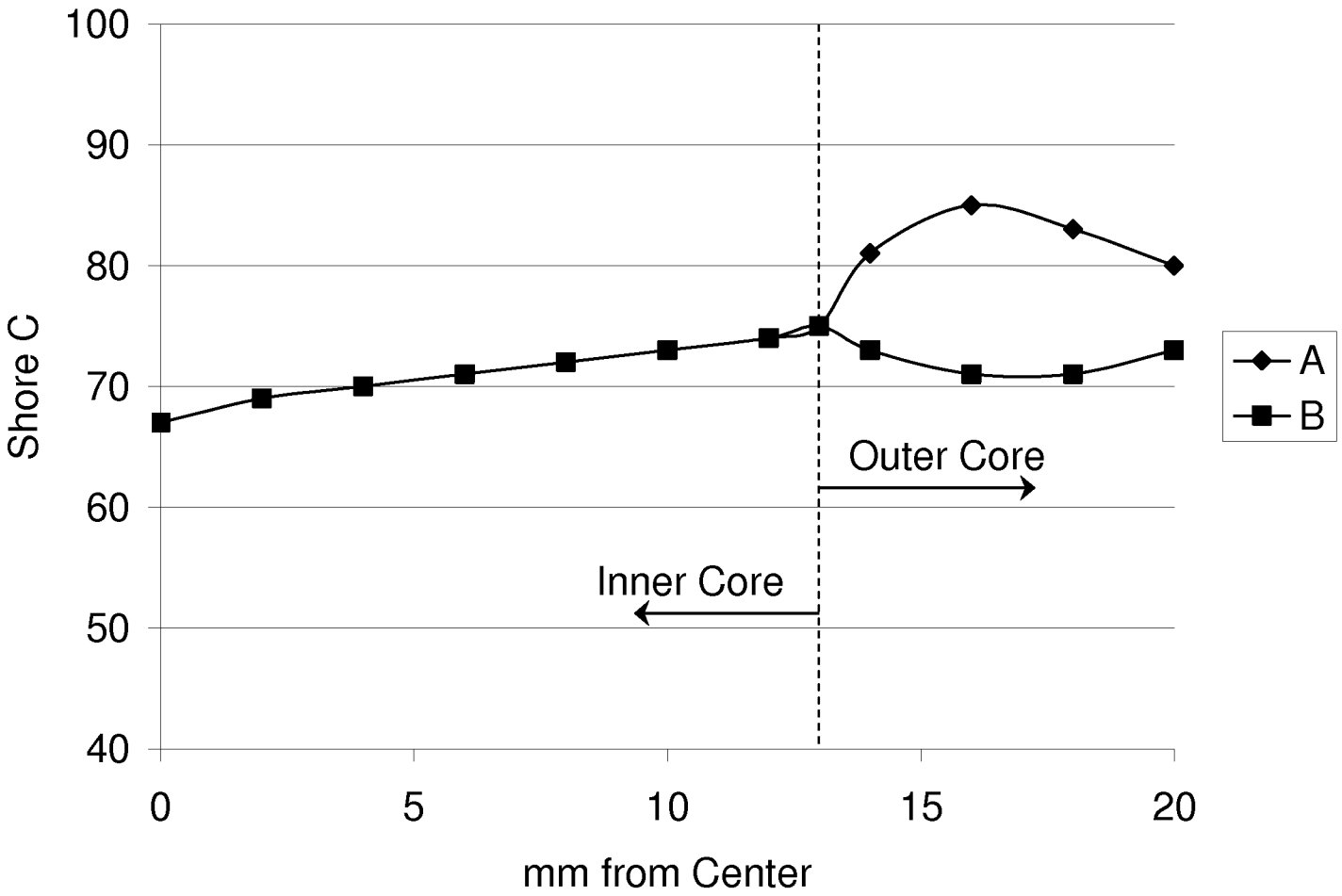
FIG. 6 is a graph of the Shore C hardness of an inventive multi-layer core as a function of the distance from its center according to illustrative embodiments.
Figure 7:
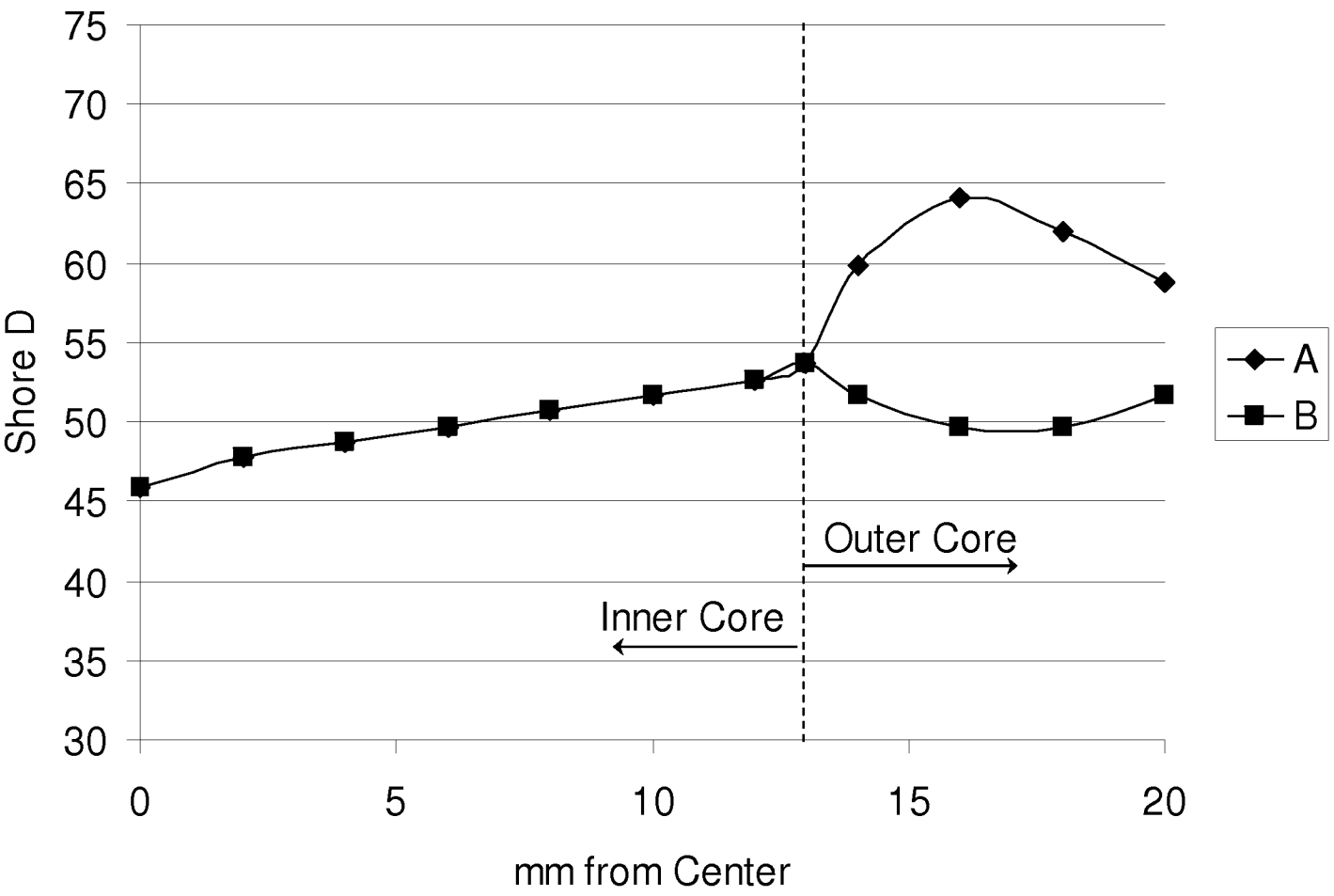
FIG. 7 is a graph of the Shore D hardness of an inventive multi-layer core as a function of the distance from its center according to illustrative embodiments.

FIGS. 6 and 7 illustrate several golf balls according to the invention. The inner core layer may have a hardness gradient represented by slope A, the outer core layer meanwhile having a hardness gradient represented by either curve B or curve C. In each of these cases, the first hardness is located at the geometric center (0 mm from the center), the second and third hardnesses are located on the first outer surface and inner surface, respectively, about the vertical dotted line 10 mm to 15 mm from the geometric center. In FIGS. 6 and 7, the second and third hardnesses are similar. The fourth hardness is located about 20 mm from the geometric center, and the fifth hardness appears between the third and fourth hardnesses in a region extending between about 10% and about 90% of the distance from the inner surface to the second outer surface. As discussed more fully throughout, each embodiment defines particular examples of possible hardness relationships between the first, second third, fourth and fifth hardnesses.

Examples of suitable formulations for several embodiments of golf ball 10 as discussed in SECTION IV are summarized in the following TABLE IV:

TABLE IV

| Components | Ranges | Ranges Outer Core | | |
|---|---|---|---|---|
| (phr) | Inner Core | A | B | C |
| ZDA | 40-50 | 30-45 | 30-45 | 30-45 |
| ZnO | 5-10 | 5-10 | 5-10 | 5-10 |
| $BaSO_4$ | Vary to achieve targeted specific gravity | | | |
| VANOX MBPC* (Antioxidant) | 0.2-1.2 | 0 | 0-1.0 | 0.2-1.2 |
| TRIGONOX** | 0.5-1.2 | 0 | 0.2-0.8 | 0.5-1.2 |
| PERKADOX BC-FF*** | — | 0.5-1.0 | 0-1.0 | 0 |
| Polybutadiene | 100 | 100 | 100 | 100 |
| Trans polyisoprene | 0-15 | 0-15 | 0-15 | 0-15 |
| ZnPCTP | 0-3 | 0-3 | 0-3 | 0-3 |
| Regrind | 10-30 | 10-30 | 10-30 | 10-30 |
| antioxidant/initiator ratio | 0.33-4.8 | 0 | 0-10 | 0.33-4.8 |
| Cure Temp. (° F.) | 290° F.-315° F. | 100° F.-150° F. | 100° F.-150° F. | 100° F.-150° F. |
| Cure Time $T_1$ (min) | 15-25 | 1-3 | 1-3 | 1-3 |
| Cure Temp. (° F.) | 290° F.-315° F. | 335° F.-365° F. | 335° F.-365° F. | 335° F.-365° F. |
| Cure Time $T_2$ (min) | — | 9-14 | 9-14 | 9-14 |
| Layer Diameter/Thickness(in) | 0.75-1.25 | 0.14-0.415 | 0.14-0.415 | 0.14-0.415 |
| Atti compression | — | 75-100 | 75-100 | 75-100 |
| COR @ 125 ft/s | — | 0.795-0.825 | 0.795-0.825 | 0.795-0.825 |

The inventive cores of the invention may also include additional materials as disclosed herein.

Figure 8:
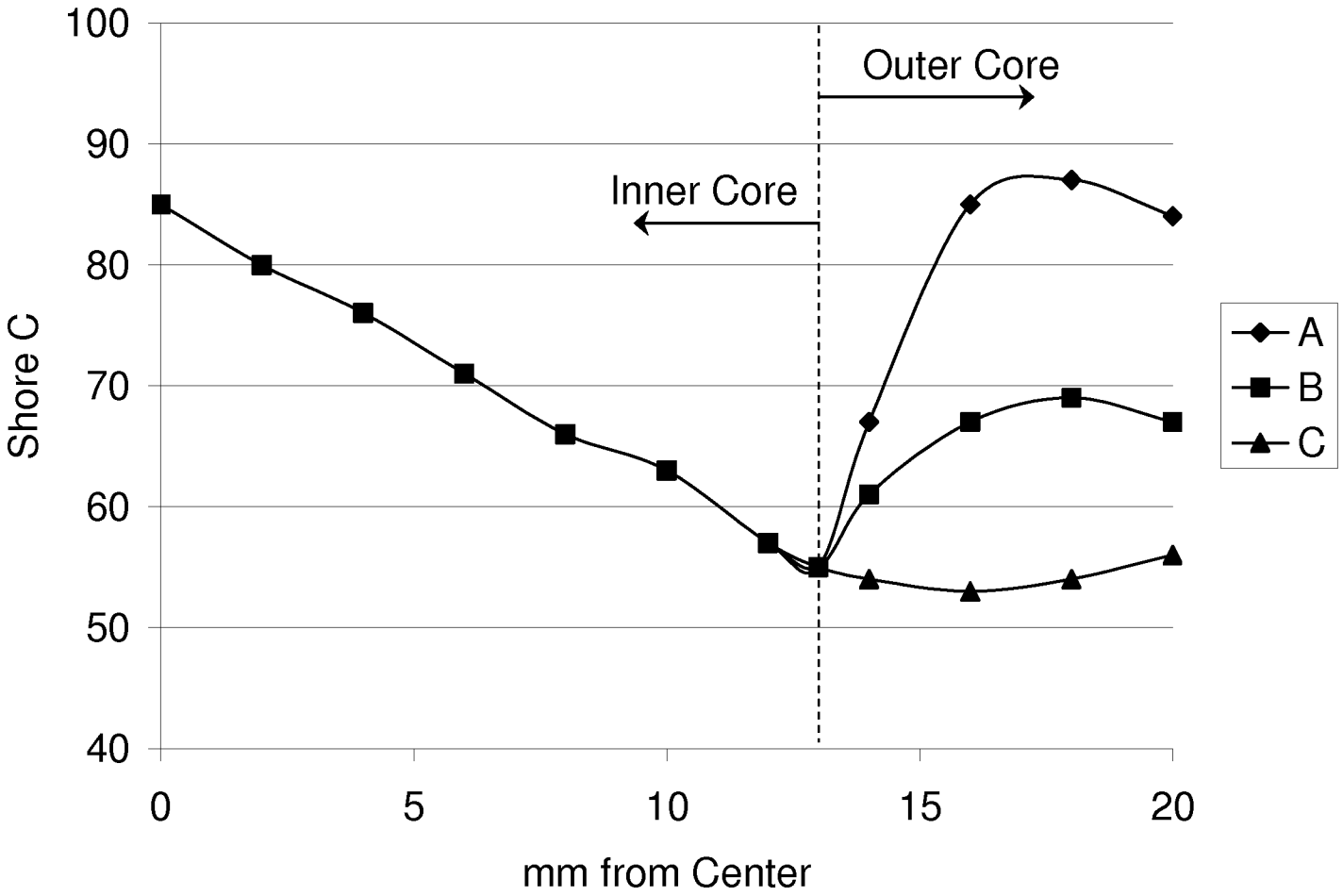
FIG. 8 is a graph of the Shore C hardness of an inventive multi-layer core as a function of the distance from its center according to illustrative embodiments.
Figure 9:
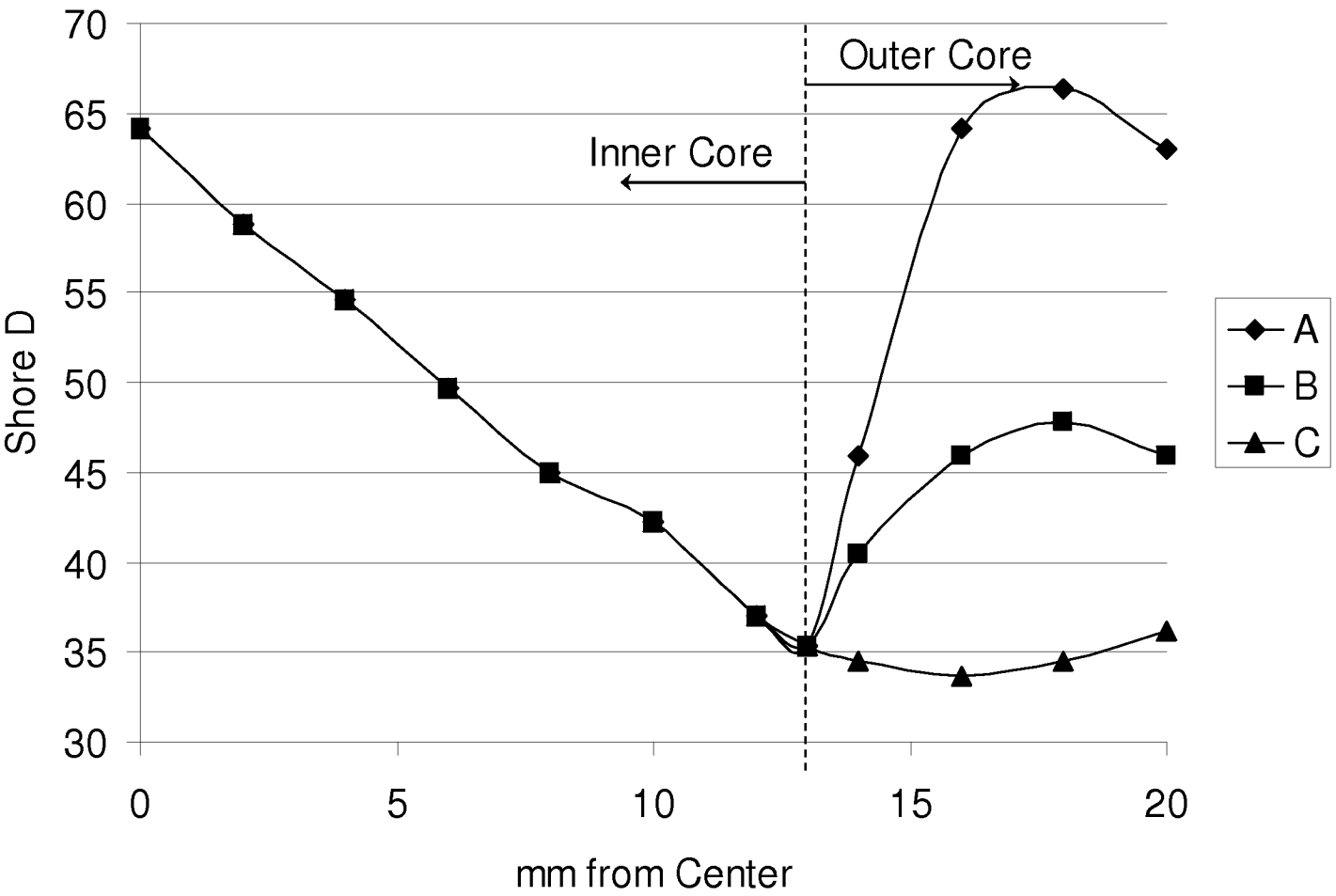
FIG. 9 is a graph of the Shore D hardness of an inventive multi-layer core as a function of the distance from its center according to illustrative embodiments.
Figure 10A:
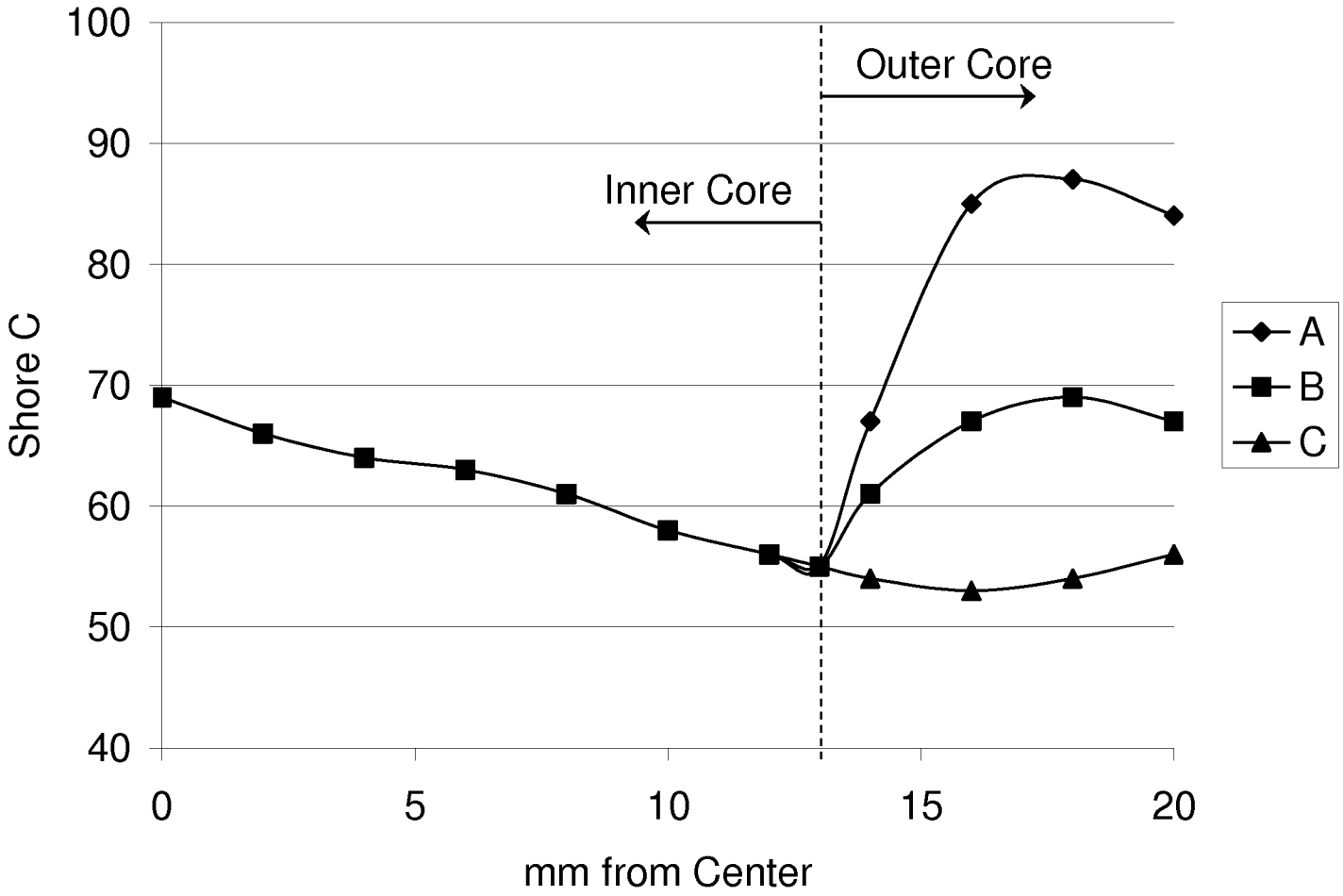
FIGS. 10A and 11A are graphs of the Shore C hardness of an inventive multi-layer core as a function of the distance from its center according to illustrative embodiments.
Figure 10B:
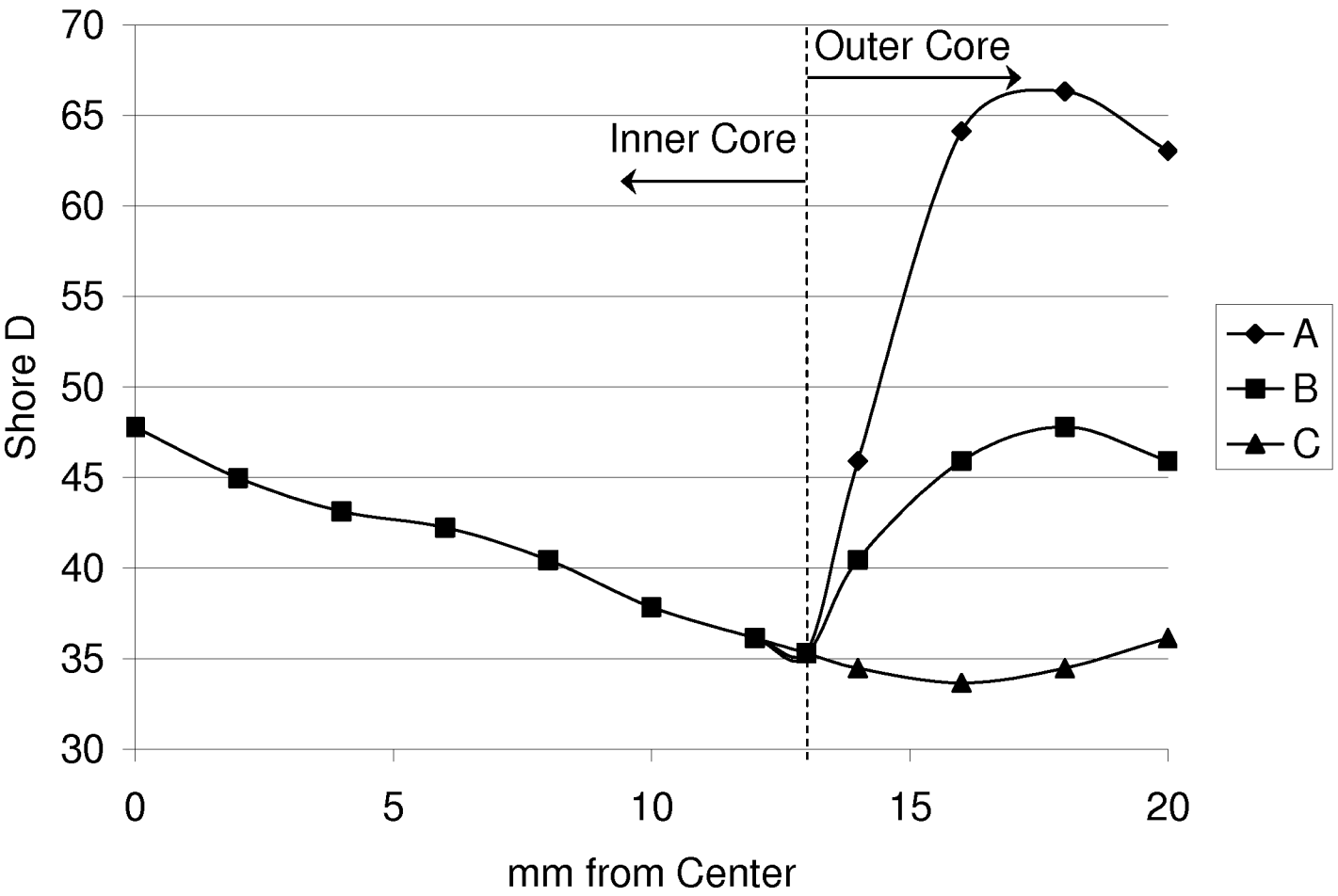
FIGS. 10B and 11B are graphs of the Shore D hardness of an inventive multi-layer core as a function of the distance from its center according to illustrative embodiments.
Figure 11A:
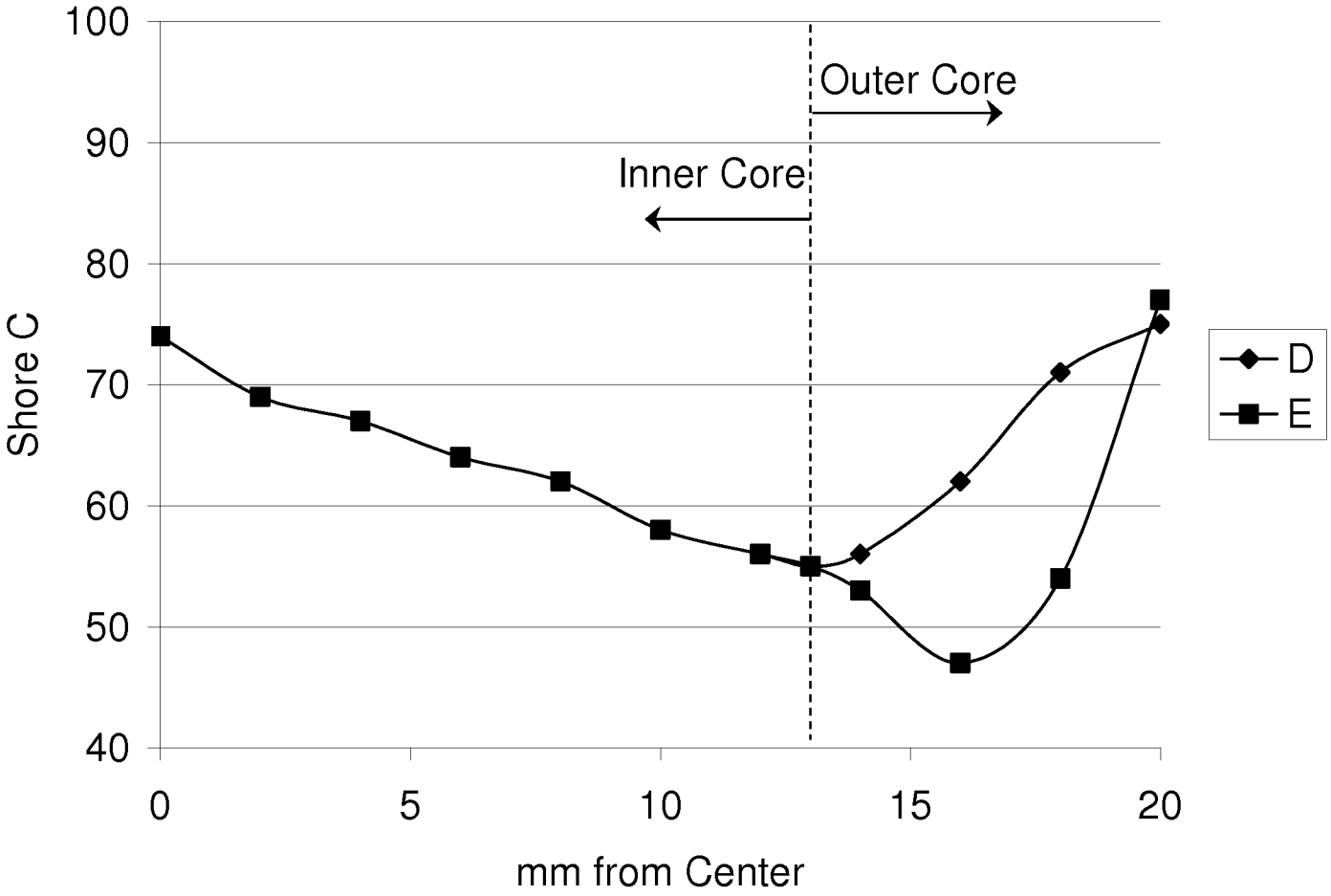
Figure 11B:
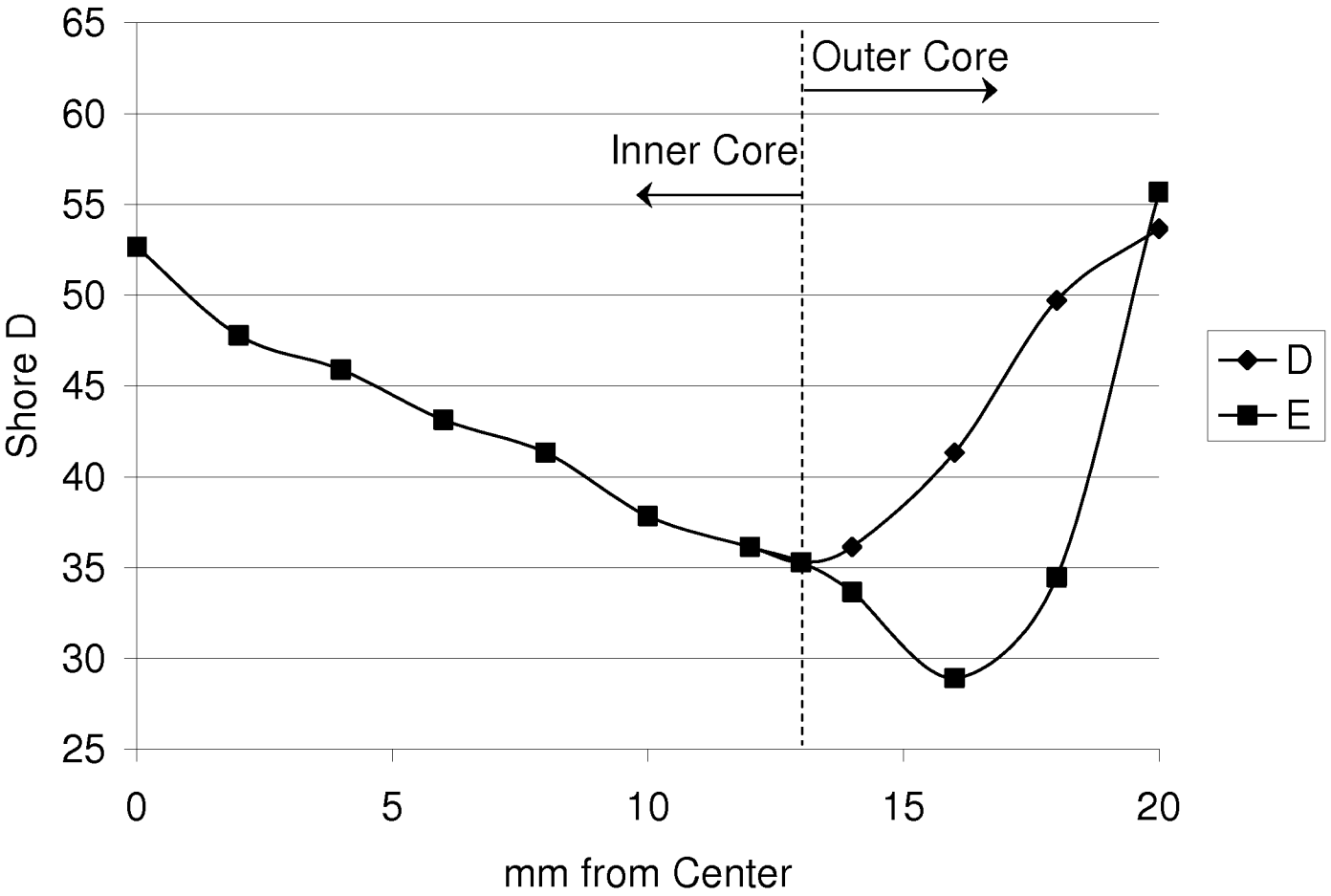

FIGS. 8 and 9 illustrate several golf balls according to the invention. The inner core layer may have a hardness gradient represented by slope A, the outer core layer meanwhile having a hardness gradient represented by either of curves B, C or D. In each of these cases, the first hardness is located at the geometric center (0 mm from the center), the second and third hardnesses are located on the first outer surface and inner surface, respectively, about the vertical dotted line 10 mm to 15 mm from the geometric center. In FIGS. 8 and 9, the second and third hardnesses are similar. The fourth hardness is located about 20 mm from the geometric center, and the fifth hardness appears between the third and fourth hardnesses in a region extending between about 10% and about 90% of the distance from the inner surface to the second outer surface. As discussed more fully throughout, each embodiment defines particular examples of possible hardness relationships between the first, second third, fourth and fifth hardnesses.

Examples of suitable formulations for several embodiments of golf ball 10 as discussed in SECTION V are summarized in the following TABLES V and VI:

TABLE V

| Components (phr) | Ranges Inner Core | Ranges Outer Core A | B | C |
|---|---|---|---|---|
| ZDA | 25-35 | 30-45 | 30-45 | 30-45 |
| ZnO | 5-10 | 5-10 | 5-10 | 5-10 |
| $BaSO_4$ | Vary to achieve targeted specific gravity | | | |
| VANOX MBPC (Antioxidant) | 0.2-1.2 | 0 | 0-1.0 | 0.2-1.2 |
| TRIGONOX 265 | 0.5-1.2 | 0 | 0.2-0.8 | 0.5-1.2 |
| PERKADOX BC-FF | — | 0.5-1.0 | 0-1.0 | 0 |
| Polybutadiene | 100 | 85-100 | 85-100 | 85-100 |
| Trans polyisoprene | 0-15 | 0-15 | 0-15 | 0-15 |
| ZnPCTP | 0-3 | 0-3 | 0-3 | 0-3 |
| Regrind | 10-30 | 10-30 | 10-30 | 10-30 |
| antioxidant/initiator ratio | 0.33-4.8 | 0 | 0-10 | 0.33-4.8 |
| Cure Temp. (° F.) | 285° F.-310° F. | 100° F.-150° F. | 100° F.-150° F. | 100° F.-150° F. |
| Cure Time $T_1$ (min) | 15-20 | 1-3 | 1-3 | 1-3 |
| Cure Temp. (° F.) | 285° F.-310° F. | 335° F.-365° F. | 335° F.-365° F. | 335° F.-365° F. |
| Cure Time $T_2$ (min) | — | 9-14 | 9-14 | 9-14 |
| Layer Diameter/Thickness(in) | 0.25-1.25 | 0.14-0.415 | 0.14-0.415 | 0.14-0.415 |
| Atti compression | — | 75-100 | 75-100 | 75-100 |
| COR @ 125 ft/s | — | 0.795-0.825 | 0.795-0.825 | 0.795-0.825 |

TABLE VI

| Components (phr) | Ranges Inner Core | Ranges Outer Core D | E |
|---|---|---|---|
| ZDA | 25-35 | 25-35 | 25-35 |
| ZnO | 5-10 | 5-10 | 5-10 |
| $BaSO_4$ | Vary to achieve targeted specific gravity | | |
| VANOX MBPC (Antioxidant) | 0.2-1.2 | 0-0.5 | 0-1.0 |
| TRIGONOX 265 | 0.5-1.2 | 0 | 0 |
| PERKADOX BC-FF | — | 0.5-1.5 | 0.5-1.5 |
| Polybutadiene | 100 | 100 | 100 |
| Trans polyisoprene | 0-15 | 0-15 | 0-15 |
| ZnPCTP | 0-3 | 0-3 | 0-3 |
| Regrind | 10-30 | 10-30 | 10-30 |
| antioxidant/initiator ratio | 0.33-4.8 | 0-1.0 | 0-2.0 |
| Cure Temp. (° F.) | 285° F.-310° F. | 330-360 | 330-360 |
| Cure Time $T_1$ (min) | 15-20 | 8-15 | 8-15 |
| Layer Diameter/Thickness(in) | 0.25-1.25 | | |

The inventive cores of the invention may also include additional materials as disclosed herein.

FIGS. 10A, 10B and 11A, 11B illustrate several golf balls according to the invention. The inner core layer may have a hardness gradient represented by slope A, the outer core layer meanwhile having a hardness gradient represented by either of curves B, C, D, E or F. In each of these cases, the first hardness is located at the geometric center (0 mm from the center), the second and third hardnesses are located on the first outer surface and inner surface, respectively, about the vertical dotted line 10 mm to 15 mm from the geometric center. In FIGS. 10A, 10B and 11A, 11B, the second and third hardnesses are similar. The fourth hardness is located about 20 mm from the geometric center, and the fifth hardness appears between the third and fourth hardnesses in a region extending between about 10% and about 90% of the distance from the inner surface to the second outer surface. As discussed more fully throughout, each embodiment defines particular examples of possible hardness relationships between the first, second third, fourth and fifth hardnesses.

The surface hardness of a core is obtained from the average of a number of measurements taken from opposing hemispheres of a core, taking care to avoid making measurements on the parting line of the core or on surface defects, such as holes or protrusions. Hardness measurements are made pursuant to ASTM D-2240 "Indentation Hardness of Rubber and Plastic by Means of a Durometer." Because of the curved surface of a core, care must be taken to insure that the core is centered under the durometer indentor before a surface hardness reading is obtained. A calibrated, digital durometer, capable of reading to 0.1 hardness units is used for all hardness measurements and is set to take the peak hardness reading. The digital durometer must be attached to, and its foot made parallel to, the base of an automatic stand, such that the weight on the durometer and attack rate conform to ASTM D-2240.

To prepare a core for hardness gradient measurements, the core is gently pressed into a hemispherical holder having an internal diameter approximately slightly smaller than the diameter of the core, such that the core is held in place in the hemispherical portion of the holder while concurrently leaving the geometric central plane of the core exposed. The core is secured in the holder by friction, such that it will not move during the cutting and grinding steps, but the friction is not so excessive that distortion of the natural shape of the core would result. The core is secured such that the parting line of the core is roughly parallel to the top of the holder. The diameter of the core is measured 90 degrees to this orientation prior to securing. A measurement is also made from the bottom of the holder to the top of the core to provide a reference point for future calculations. A rough cut, made slightly above the exposed geometric center of the core using a band saw or other appropriate cutting tool, making sure that the core does not move in the holder during this step. The remainder of the core, still in the holder, is secured to the base plate of a surface grinding machine. The exposed 'rough' core surface is ground to a smooth, flat surface, revealing the geometric center of the core, which can be verified by measuring the height of the bottom of the holder to the exposed surface of the core, making sure that exactly half of the original height of the core, as measured above, has been removed to within ±0.004 inches.

Leaving the core in the holder, the center of the core is found with a center square and carefully marked and the hardness is measured at the center mark. Hardness measurements at any distance from the center of the core may be measured by drawing a line radially outward from the center mark, and measuring and marking the distance from the center, typically in 2-mm increments. All hardness measurements performed on the plane passing through the geometric center are performed while the core is still in the holder and without having disturbed its orientation, such that the test surface is constantly parallel to the bottom of the holder. The hardness difference from any predetermined location on the core (e.g., first outer surface, second outer surface, etc.) is calculated as the average hardness at the predetermined location minus the hardness at a chosen reference point at or closer to the geometric center than the predetermined location. For example, if the predetermined location is the second outer surface and is softer than its reference point, the inner surface, a negative hardness gradient results between the two points. Conversely, if inner surface is harder than the second outer surface, a positive hardness gradient results.

Golf ball compression remains an important factor to consider in maximizing playing performance. It affects the ball's spin rate off the driver as well as the feel. Initially, compression was referred to as the tightness of the windings around a golf ball. Today, compression refers to how much a ball will deform under a compressive force when a driver hits the ball. A ball actually tends to flatten out when a driver meets the ball; it deforms out of its round shape and then returns to its round shape, all in a second or two. Compression ratings of from about 70 to about 120 are common. The lower the compression rating, the more the ball will compress or deform upon impact.

People with a slower swing or slower club head speed will desire a ball having a lower compression rating. While the compression of a ball alone does not determine whether a ball flies farther—the club head speed actually determines that—compression can nevertheless influence or contribute to overall distance. For example, a golfer with a slower club head speed who uses a high compression ball will indeed lose yardage that would otherwise be achieved if that golfer used a low compression (or softer) ball. Accordingly, it is desirable to match golf ball compression rating with a player's swing speed in maximizing a golfer's performance on the green.

Several different methods can be used to measure compression, including Atti compression, Riehle compression, load/deflection measurements at a variety of fixed loads and offsets, and effective modulus. See, e.g., *Compression by Any Other Name, Science and Golf IV, Proceedings of the World Scientific Congress of Golf* (Eric Thain ed., routledge, 2002) ("*J. Dalton*") The term compression, as used herein, refers to Atti compression and is measured using an Atti compression test device. A piston compresses a ball against a spring and the piston remains fixed while deflection of the spring is measured at 1.25 mm (0.05 inches). Where a core has a very low stiffness, the compression measurement will be zero at 1.25 mm. In order to measure the compression of a core using an Atti compression tester, the core must be shimmed to a diameter of 1.680 inches because these testers are designed to measure objects having that diameter. Atti compression units can be converted to Riehle (cores), Riehle (balls), 100 kg deflection, 130-10 kg deflection or effective modulus using the formulas set forth in *J. Dalton*.

According to one aspect of the present invention, the golf ball is formulated to have a compression of between about 50 and about 120. In one embodiment, the compression of core 16 is greater than about 50. In another embodiment, the compression of core 16 is greater than about 70. In yet another embodiment, the compression of core 16 is from about 80 to about 100.

The distance that a golf ball would travel upon impact is a function of the coefficient of restitution (COR) and the aerodynamic characteristics of the ball. For golf balls, COR has been approximated as a ratio of the velocity of the golf ball after impact to the velocity of the golf ball prior to impact. The COR varies from 0 to 1.0. A COR value of 1.0 is equivalent to a perfectly elastic collision, that is, all the energy is transferred in the collision. A COR value of 0.0 is equivalent to a perfectly inelastic collision—that is, all of the energy is lost in the collision.

COR, as used herein, is determined by firing a golf ball or golf ball subassembly (e.g., a golf ball core) from an air cannon at two given velocities and calculating the COR at a velocity of 125 ft/s. Ball velocity is calculated as a ball approaches ballistic light screens which are located between the air cannon and a steel plate at a fixed distance. As the ball travels toward the steel plate, each light screen is activated, and the time at each light screen is measured. This provides an incoming transit time period inversely proportional to the ball's incoming velocity. The ball impacts the steel plate and rebounds through the light screens, which again measure the time period required to transit between the light screens. This provides an outgoing transit time period inversely proportional to the ball's outgoing velocity. COR is then calculated as the ratio of the outgoing transit time period to the incoming transit time period, $COR=V_{out}/V_{in}=T_{in}/T_{out}$. Preferably, a golf ball according to the present invention has a COR of at least about 0.78, more preferably, at least about 0.80.

The spin rate of a golf ball also remains an important golf ball characteristic. High spin rate allows skilled players more flexibility in stopping the ball on the green if they are able to control a high spin ball. On the other hand, recreational players often prefer a low spin ball since they do not have the ability to intentionally control the ball, and lower spin balls tend to drift less off the green.

Golf ball spin is dependent on variables including, for example, distribution of the density or specific gravity within a golf ball. For example, when the density or specific gravity is located in the golf ball center, a lower moment of inertia results which increases spin rate. Alternatively, when the density or specific gravity is concentrated in the outer regions of the golf ball, a higher moment of inertia results with a lower spin rate. The moment of inertia for a one piece ball that is 1.62 ounces and 1.68 inches in diameter is approximately 0.4572 oz-in$^2$, which is the baseline moment of inertia value.

Accordingly, by varying the materials and the hardness of the regions of each core layer, different moments of inertia may be achieved for the golf ball of the present invention. In one embodiment, the resulting golf ball has a moment of inertia of from about to 0.440 to about 0.455 oz-in$^2$. In another embodiment, the golf balls of the present invention have a moment of inertia of from about 0.456 oz-in$^2$ to about 0.470 oz-in$^2$. In yet another embodiment, the golf ball has a moment of inertia of from about 0.450 oz-in$^2$ to about 0.460 oz-in$^2$.

While the inventive golf ball may be formed from a variety of differing and conventional cover materials (both intermediate layer(s) and outer cover layer), preferred cover materials include, but are not limited to:

(1) Polyurethanes, such as those prepared from polyols or polyamines and diisocyanates or polyisocyanates and/or their prepolymers, and those disclosed in U.S. Pat. Nos. 5,334,673 and 6,506,851;

(2) Polyureas, such as those disclosed in U.S. Pat. Nos. 5,484,870 and 6,835,794; and (3) Polyurethane-urea hybrids, blends or copolymers comprising urethane or urea segments.

Suitable polyurethane compositions comprise a reaction product of at least one polyisocyanate and at least one curing agent. The curing agent can include, for example, one or more polyamines, one or more polyols, or a combination thereof. The polyisocyanate can be combined with one or more polyols to form a prepolymer, which is then combined with the at least one curing agent. Thus, the polyols described herein are suitable for use in one or both components of the polyurethane material, i.e., as part of a prepolymer and in the curing agent. Suitable polyurethanes are described in U.S. Patent Application Publication No. 2005/0176523, which is incorporated by reference in its entirety.

Any polyisocyanate available to one of ordinary skill in the art is suitable for use according to the invention. Exemplary polyisocyanates include, but are not limited to, 4,4'-diphenylmethane diisocyanate (MDI); polymeric MDI; carbodiimide-modified liquid MDI; 4,4'-dicyclohexylmethane diisocyanate ($H_{12}$MDI); p-phenylene diisocyanate (PPDI); m-phenylene diisocyanate (MPDI); toluene diisocyanate (TDI); 3,3'-dimethyl-4,4'-biphenylene diisocyanate; isophoronediisocyanate; 1,6-hexamethylene diisocyanate (HDI); naphthalene diisocyanate; xylene diisocyanate; p-tetramethylxylene diisocyanate; m-tetramethylxylene diisocyanate; ethylene diisocyanate; propylene-1,2-diisocyanate; tetramethylene-1,4-diisocyanate; cyclohexyl diisocyanate; dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; triisocyanate of HDI; triisocyanate of 2,4,4-trimethyl-1,6-hexane diisocyanate; tetracene diisocyanate; napthalene diisocyanate; anthracene diisocyanate; isocyanurate of toluene diisocyanate; uretdione of hexamethylene diisocyanate; and mixtures thereof. Polyisocyanates are known to those of ordinary skill in the art as having more than one isocyanate group, e.g., di-isocyanate, tri-isocyanate, and tetra-isocyanate. Preferably, the polyisocyanate includes MDI, PPDI, TDI, or a mixture thereof, and more preferably, the polyisocyanate includes MDI. It should be understood that, as used herein, the term MDI includes 4,4'-diphenylmethane diisocyanate, polymeric MDI, carbodiimide-modified liquid MDI, and mixtures thereof and, additionally, that the diisocyanate employed may be "low free monomer," understood by one of ordinary skill in the art to have lower levels of "free" monomer isocyanate groups, typically less than about 0.1% free monomer isocyanate groups. Examples of "low free monomer" diisocyanates include, but are not limited to Low Free Monomer MDI, Low Free Monomer TDI, and Low Free Monomer PPDI.

The at least one polyisocyanate should have less than about 14% unreacted NCO groups. Preferably, the at least one polyisocyanate has no greater than about 8.0% NCO, more preferably no greater than about 7.8%, and most preferably no greater than about 7.5% NCO with a level of NCO of about 7.2 or 7.0, or 6.5% NCO commonly used.

Any polyol available to one of ordinary skill in the art is suitable for use according to the invention. Exemplary polyols include, but are not limited to, polyether polyols, hydroxy-terminated polybutadiene (including partially/fully hydrogenated derivatives), polyester polyols, polycaprolactone polyols, and polycarbonate polyols. In one preferred embodiment, the polyol includes polyether polyol. Examples include, but are not limited to, polytetramethylene ether glycol (PTMEG), polyethylene propylene glycol, polyoxypropylene glycol, and mixtures thereof. The hydrocarbon chain can have saturated or unsaturated bonds and substituted or unsubstituted aromatic and cyclic groups. Preferably, the polyol of the present invention includes PTMEG.

In another embodiment, polyester polyols are included in the polyurethane material. Suitable polyester polyols include, but are not limited to, polyethylene adipate glycol; polybutylene adipate glycol; polyethylene propylene adipate glycol; o-phthalate-1,6-hexanediol; poly(hexamethylene adipate)glycol; and mixtures thereof. The hydrocarbon chain can have saturated or unsaturated bonds, or substituted or unsubstituted aromatic and cyclic groups.

In another embodiment, polycaprolactone polyols are included in the materials of the invention. Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and mixtures thereof. The hydrocarbon chain can have saturated or unsaturated bonds, or substituted or unsubstituted aromatic and cyclic groups.

In yet another embodiment, polycarbonate polyols are included in the polyurethane material of the invention. Suitable polycarbonates include, but are not limited to, polyphthalate carbonate and poly(hexamethylene carbonate) glycol. The hydrocarbon chain can have saturated or unsaturated bonds, or substituted or unsubstituted aromatic and cyclic groups. In one embodiment, the molecular weight of the polyol is from about 200 to about 4000.

Polyamine curatives are also suitable for use in the polyurethane composition of the invention and have been found to improve cut, shear, and impact resistance of the resultant balls. Preferred polyamine curatives include, but are not limited to, 3,5-dimethylthio-2,4-toluenediamine and isomers thereof; 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); polytetramethyleneoxide-di-p-aminobenzoate; N,N'-dialkyldiamino diphenyl methane; p,p'-methylene dianiline; m-phenylenediamine; 4,4'-methylene-bis-(2-chloroaniline); 4,4'-methylene-bis-(2,6-diethylaniline); 4,4'-methylene-bis-(2,3-dichloroaniline); 4,4'-diamino-3,3'-diethyl-5,5'-dimethyl diphenylmethane; 2,2', 3,3'-tetrachloro diamino diphenylmethane; trimethylene glycol di-p-aminobenzoate; and mixtures thereof. Preferably, the curing agent of the present invention includes 3,5-dimethylthio-2,4-toluenediamine and isomers thereof, such as ETHACURE® 300, commercially available from Albermarle Corporation of Baton Rouge, La. Suitable polyamine curatives, which include both primary and secondary amines, preferably have molecular weights ranging from about 64 to about 2000.

At least one of a diol, triol, tetraol, or hydroxy-terminated curatives may be added to the aforementioned polyurethane composition. Suitable diol, triol, and tetraol groups include ethylene glycol; diethylene glycol; polyethylene glycol; propylene glycol; polypropylene glycol; lower molecular weight polytetramethylene ether glycol; 1,3-bis(2-hydroxyethoxy)benzene; 1,3-bis-[2-(2-hydroxyethoxy)ethoxy]benzene; 1,3-bis-{2-[2-(2-hydroxyethoxy)ethoxy]ethoxy}benzene; 1,4-butanediol; 1,5-pentanediol; 1,6-hexanediol; resorcinol-di-(β-hydroxyethyl)ether; hydroquinone-di-(β-hydroxyethyl)ether; and mixtures thereof. Preferred hydroxy-terminated curatives include 1,3-bis(2-hydroxyethoxy)benzene; 1,3-bis-[2-(2-hydroxyethoxy)ethoxy]benzene; 1,3-bis-{2-[2-(2-hydroxyethoxy)ethoxy]ethoxy}benzene; 1,4-butanediol, and mixtures thereof. Preferably, the hydroxy-terminated curatives have molecular weights ranging from about 48 to 2000. It should be understood that molecular weight, as used herein, is the absolute weight average molecular weight and would be understood as such by one of ordinary skill in the art.

Both the hydroxy-terminated and amine curatives can include one or more saturated, unsaturated, aromatic, and cyclic groups. Additionally, the hydroxy-terminated and amine curatives can include one or more halogen groups. The polyurethane composition can be formed with a blend or mixture of curing agents. If desired, however, the polyurethane composition may be formed with a single curing agent.

In a preferred embodiment of the present invention, saturated polyurethanes are used to form one or more of the cover layers, preferably the outer cover layer, and may be selected from among both castable thermoset and thermoplastic polyurethanes.

In this embodiment, the saturated polyurethanes of the present invention are substantially free of aromatic groups or moieties. Saturated polyurethanes suitable for use in the invention are a product of a reaction between at least one polyurethane prepolymer and at least one saturated curing agent. The polyurethane prepolymer is a product formed by a reaction between at least one saturated polyol and at least one saturated diisocyanate. As is well known in the art, that a catalyst may be employed to promote the reaction between the curing agent and the isocyanate and polyol, or the curing agent and the prepolymer.

Saturated diisocyanates which can be used include, without limitation, ethylene diisocyanate; propylene-1,2-diisocyanate; tetramethylene-1,4-diisocyanate; 1,6-hexamethylene-diisocyanate (HDI); 2,2,4-trimethylhexamethylene diisocyanate; 2,4,4-trimethylhexamethylene diisocyanate; dodecane-1,12-diisocyanate; dicyclohexylmethane diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane;
isophorone diisocyanate; methyl cyclohexylene diisocyanate; triisocyanate of HDI; triisocyanate of 2,2,4-trimethyl-1,6-hexane diisocyanate. The most preferred saturated diisocyanates are 4,4'-dicyclohexylmethane diisocyanate and isophorone diisocyanate.

Saturated polyols which are appropriate for use in this invention include without limitation polyether polyols such as polytetramethylene ether glycol and poly(oxypropylene) glycol. Suitable saturated polyester polyols include polyethylene adipate glycol, polyethylene propylene adipate glycol, polybutylene adipate glycol, polycarbonate polyol and ethylene oxide-capped polyoxypropylene diols. Saturated polycaprolactone polyols which are useful in the invention include diethylene glycol-initiated polycaprolactone, 1,4-butanediol-initiated polycaprolactone, 1,6-hexanediol-initiated polycaprolactone; trimethylol propane-initiated polycaprolactone, neopentyl glycol initiated polycaprolactone, and polytetramethylene ether glycol-initiated polycaprolactone. The most preferred saturated polyols are polytetramethylene ether glycol and PTMEG-initiated polycaprolactone.

Suitable saturated curatives include 1,4-butanediol, ethylene glycol, diethylene glycol, polytetramethylene ether glycol, propylene glycol; trimethanolpropane; tetra-(2-hydroxypropyl)-ethylenediamine; isomers and mixtures of isomers of cyclohexyldimethylol, isomers and mixtures of isomers of cyclohexane bis(methylamine); triisopropanolamine; ethylene diamine; diethylene triamine; triethylene tetramine; tetraethylene pentamine; 4,4'-dicyclohexylmethane diamine; 2,2,4-trimethyl-1,6-hexanediamine; 2,4,4-trimethyl-1,6-hexanediamine; diethyleneglycol di-(aminopropyl)ether; 4,4'-bis-(sec-butylamino)-dicyclohexylmethane; 1,2-bis-(sec-butylamino) cyclohexane; 1,4-bis-(sec-butylamino)cyclohexane; isophorone diamine; hexamethylene diamine; propylene diamine; 1-methyl-2,4-cyclohexyl diamine; 1-methyl-2,6-cyclohexyl diamine; 1,3-diaminopropane; dimethylamino propylamine; diethylamino propylamine; imido-bis-propylamine; isomers and mixtures of isomers of diaminocyclohexane; monoethanolamine; diethanolamine; triethanolamine; monoisopropanolamine; and diisopropanolamine. The most preferred saturated curatives are 1,4-butanediol, 1,4-cyclohexyldimethylol and 4,4'-bis-(sec-butylamino)-dicyclohexylmethane.

Alternatively, other suitable polymers include partially or fully neutralized ionomer, metallocene, or other single-site catalyzed polymer, polyester, polyamide, non-ionomeric thermoplastic elastomer, copolyether-esters, copolyether-amides, polycarbonate, polybutadiene, polyisoprene, polystryrene block copolymers (such as styrene-butadiene-styrene), styrene-ethylene-propylene-styrene, styrene-ethylene-butylene-styrene, and the like, and blends thereof. Thermosetting polyurethanes or polyureas are suitable for the outer cover layers of the golf balls of the present invention.

Additionally, polyurethane can be replaced with or blended with a polyurea material. Polyureas are distinctly different from polyurethane compositions, but also result in desirable aerodynamic and aesthetic characteristics when used in golf ball components. The polyurea-based compositions are preferably saturated in nature.

Without being bound to any particular theory, it is now believed that substitution of the long chain polyol segment in the polyurethane prepolymer with a long chain polyamine oligomer soft segment to form a polyurea prepolymer, improves shear, cut, and resiliency, as well as adhesion to other components. Thus, the polyurea compositions of this invention may be formed from the reaction product of an isocyanate and polyamine prepolymer crosslinked with a curing agent. For example, polyurea-based compositions of the invention may be prepared from at least one isocyanate, at least one polyether amine, and at least one diol curing agent or at least one diamine curing agent.

Any polyamine available to one of ordinary skill in the art is suitable for use in the polyurea prepolymer. Polyether amines are particularly suitable for use in the prepolymer. As used herein, "polyether amines" refer to at least polyoxyalkyleneamines containing primary amino groups attached to the terminus of a polyether backbone. Due to the rapid reaction of isocyanate and amine, and the insolubility of many urea products, however, the selection of diamines and polyether amines is limited to those allowing the successful formation of the polyurea prepolymers. In one embodiment, the polyether backbone is based on tetramethylene, propylene, ethylene, trimethylolpropane, glycerin, and mixtures thereof.

Suitable polyether amines include, but are not limited to, methyldiethanolamine; polyoxyalkylenediamines such as, polytetramethylene ether diamines, polyoxypropylenetriamine, and polyoxypropylene diamines; poly(ethylene oxide capped oxypropylene) ether diamines; propylene oxide-based triamines; triethyleneglycoldiamines; trimethylolpropane-based triamines; glycerin-based triamines; and mixtures thereof. In one embodiment, the polyether amine used to form the prepolymer is JEFFAMINE® D2000 (manufactured by Huntsman Chemical Co. of Austin, Tex.).

The molecular weight of the polyether amine for use in the polyurea prepolymer may range from about 100 to about 5000. In one embodiment, the polyether amine molecular weight is about 200 or greater, preferably about 230 or greater. In another embodiment, the molecular weight of the polyether amine is about 4000 or less. In yet another embodiment, the molecular weight of the polyether amine is about 600 or greater. In still another embodiment, the molecular weight of the polyether amine is about 3000 or less. In yet another embodiment, the molecular weight of the polyether amine is between about 1000 and about 3000, and more preferably is between about 1500 to about 2500. Because lower molecular weight polyether amines may be prone to forming solid polyureas, a higher molecular weight oligomer, such as JEFFAMINE® D2000, is preferred.

As briefly discussed above, some amines may be unsuitable for reaction with the isocyanate because of the rapid reaction between the two components. In particular, shorter chain amines are fast reacting. In one embodiment, however, a hindered secondary diamine may be suitable for use in the prepolymer. Without being bound to any particular theory, it is believed that an amine with a high level of steric hindrance, e.g., a tertiary butyl group on the nitrogen atom, has a slower reaction rate than an amine with no hindrance or a low level of hindrance. For example, 4,4'-bis-(sec-butylamino)-dicyclohexylmethane (CLEARLINK® 1000) may be suitable for use in combination with an isocyanate to form the polyurea prepolymer.

Any isocyanate available to one of ordinary skill in the art is suitable for use in the polyurea prepolymer. Isocyanates for use with the present invention include aliphatic, cycloaliphatic, araliphatic, aromatic, any derivatives thereof, and combinations of these compounds having two or more isocyanate (NCO) groups per molecule. The isocyanates may be organic polyisocyanate-terminated prepolymers. The isocyanate-containing reactable component may also include any isocyanate-functional monomer, dimer, trimer, or multimeric adduct thereof, prepolymer, quasi-prepolymer, or mixtures thereof. Isocyanate-functional compounds may include monoisocyanates or polyisocyanates that include any isocyanate functionality of two or more.

Suitable isocyanate-containing components include diisocyanates having the generic structure: O═C═N—R—N═C═O, where R is preferably a cyclic, aromatic, or linear or branched hydrocarbon moiety containing from about 1 to about 20 carbon atoms. The diisocyanate may also contain one or more cyclic groups or one or more phenyl groups. When multiple cyclic or aromatic groups are present, linear and/or branched hydrocarbons containing from about 1 to about 10 carbon atoms can be present as spacers between the cyclic or aromatic groups. In some cases, the cyclic or aromatic group(s) may be substituted at the 2-, 3-, and/or 4-positions, or at the ortho-, meta-, and/or para-positions, respectively. Substituted groups may include, but are not limited to, halogens, primary, secondary, or tertiary hydrocarbon groups, or a mixture thereof.

Examples of diisocyanates that can be used with the present invention include, but are not limited to, substituted and isomeric mixtures including 2,2'-, 2,4'-, and 4,4'-diphenylmethane diisocyanate; 3,3'-dimethyl-4,4'-biphenylene diisocyanate; toluene diisocyanate; polymeric MDI; carbodiimide-modified liquid 4,4'-diphenylmethane diisocyanate; para-phenylene diisocyanate; meta-phenylene diisocyanate; triphenyl methane-4,4'- and triphenyl methane-4,4'-triisocyanate; naphthylene-1,5-diisocyanate; 2,4'-, 4,4'-, and 2,2-biphenyl diisocyanate; polyphenyl polymethylene polyisocyanate; mixtures of MDI and PMDI; mixtures of PMDI and TDI; ethylene diisocyanate; propylene-1,2-diisocyanate; tetramethylene-1,2-diisocyanate; tetramethylene-1,3-diisocyanate; tetramethylene-1,4-diisocyanate; 1,6-hexamethylene-diisocyanate; octamethylene diisocyanate; decamethylene diisocyanate; 2,2,4-trimethylhexamethylene diisocyanate; 2,4,4-trimethylhexamethylene diisocyanate; dodecane-1,12-diisocyanate; cyclobutane-1,3-diisocyanate; cyclohexane-1,2-diisocyanate; cyclohexane-1,3-diisocyanate; cyclohexane-1,4-diisocyanate; methyl-cyclohexylene diisocyanate; 2,4-methylcyclohexane diisocyanate; 2,6-methylcyclohexane diisocyanate; 4,4'-dicyclohexyl diisocyanate; 2,4'-dicyclohexyl diisocyanate; 1,3,5-cyclohexane triisocyanate; isocyanatomethylcyclohexane isocyanate; 1-isocyanato-3,3,5-trimethyl-5-isocyanatomethylcyclohexane; isocyanatoethylcyclohexane isocyanate; bis(isocyanatomethyl)-cyclohexane diisocyanate; 4,4'-bis(isocyanatomethyl)dicyclohexane; 2,4'-bis(isocyanatomethyl) dicyclohexane; isophorone diisocyanate; triisocyanate of HDI; triisocyanate of 2,2,4-trimethyl-1,6-hexane diisocyanate; 4,4'-dicyclohexylmethane diisocyanate; 2,4-hexahydrotoluene diisocyanate; 2,6-hexahydrotoluene diisocyanate; 1,2-, 1,3-, and 1,4-phenylene diisocyanate; aromatic aliphatic isocyanate, such as 1,2-, 1,3-, and 1,4-xylene diisocyanate; meta-tetramethylxylene diisocyanate; para-tetramethylxylene diisocyanate; trimerized isocyanurate of any polyisocyanate, such as isocyanurate of toluene diisocyanate, trimer of diphenylmethane diisocyanate, trimer of tetramethylxylene diisocyanate, isocyanurate of hexamethylene diisocyanate, isocyanurate of isophorone diisocyanate, and mixtures thereof; dimerized uredione of any polyisocyanate, such as uretdione of toluene diisocyanate, uretdione of hexamethylene diisocyanate, and mixtures thereof; modified polyisocyanate derived from the above isocyanates and polyisocyanates; and mixtures thereof.

Examples of saturated diisocyanates that can be used with the present invention include, but are not limited to, ethylene diisocyanate; propylene-1,2-diisocyanate; tetramethylene diisocyanate; tetramethylene-1,4-diisocyanate; 1,6-hexamethylene-diisocyanate; octamethylene diisocyanate; decamethylene diisocyanate; 2,2,4-trimethylhexamethylene diisocyanate; 2,4,4-trimethylhexamethylene diisocyanate; dodecane-1,12-diisocyanate; cyclobutane-1,3-diisocyanate; cyclohexane-1,2-diisocyanate; cyclohexane-1,3-diisocyanate; cyclohexane-1,4-diisocyanate; methyl-cyclohexylene diisocyanate; 2,4-methylcyclohexane diisocyanate; 2,6-methylcyclohexane diisocyanate; 4,4'-dicyclohexyl diisocyanate; 2,4'-dicyclohexyl diisocyanate; 1,3,5-cyclohexane triisocyanate; isocyanatomethylcyclohexane isocyanate; 1-isocyanato-3,3,5-trimethyl-5-isocyanatomethylcyclohexane; isocyanatoethylcyclohexane isocyanate; bis(isocyanatomethyl)-cyclohexane diisocyanate; 4,4'-bis(isocyanatomethyl)dicyclohexane; 2,4'-bis(isocyanatomethyl) dicyclohexane; isophorone diisocyanate; triisocyanate of HDI; triisocyanate of 2,2,4-trimethyl-1,6-hexane diisocyanate; 4,4'-dicyclohexylmethane diisocyanate; 2,4-hexahydrotoluene diisocyanate; 2,6-hexahydrotoluene diisocyanate; and mixtures thereof. Aromatic aliphatic isocyanates may also be used to form light stable materials. Examples of such isocyanates include 1,2-, 1,3-, and 1,4-xylene diisocyanate; meta-tetramethylxylene diisocyanate; para-tetramethylxylene diisocyanate; trimerized isocyanurate of any polyisocyanate, such as isocyanurate of toluene diisocyanate, trimer of diphenylmethane diisocyanate, trimer of tetramethylxylene diisocyanate, isocyanurate of hexamethylene diisocyanate, isocyanurate of isophorone diisocyanate, and mixtures thereof; dimerized uredione of any polyisocyanate, such as uretdione of toluene diisocyanate, uretdione of hexamethylene diisocyanate, and mixtures thereof; modified polyisocyanate derived from the above isocyanates and polyisocyanates; and mixtures thereof. In addition, the aromatic aliphatic isocyanates may be mixed with any of the saturated isocyanates listed above for the purposes of this invention.

The number of unreacted NCO groups in the polyurea prepolymer of isocyanate and polyether amine may be varied to control such factors as the speed of the reaction, the resultant hardness of the composition, and the like. For instance, the number of unreacted NCO groups in the polyurea prepolymer of isocyanate and polyether amine may be less than about 14 percent. In one embodiment, the polyurea prepolymer has from about 5 percent to about 11 percent unreacted NCO groups, and even more preferably has from about 6 to about 9.5 percent unreacted NCO groups. In one embodiment, the percentage of unreacted NCO groups is about 3 percent to about 9 percent. Alternatively, the percentage of unreacted NCO groups in the polyurea prepolymer may be about 7.5 percent or less, and more preferably, about 7 percent or less. In another embodiment, the unreacted NCO content is from about 2.5 percent to about 7.5 percent, and more preferably from about 4 percent to about 6.5 percent.

When formed, polyurea prepolymers may contain about 10 percent to about 20 percent by weight of the prepolymer of free isocyanate monomer. Thus, in one embodiment, the polyurea prepolymer may be stripped of the free isocyanate monomer. For example, after stripping, the prepolymer may contain about 1 percent or less free isocyanate monomer. In another embodiment, the prepolymer contains about 0.5 percent by weight or less of free isocyanate monomer.

The polyether amine may be blended with additional polyols to formulate copolymers that are reacted with excess isocyanate to form the polyurea prepolymer. In one embodiment, less than about 30 percent polyol by weight of the copolymer is blended with the saturated polyether amine. In another embodiment, less than about 20 percent polyol by weight of the copolymer, preferably less than about 15 percent by weight of the copolymer, is blended with the polyether amine. The polyols listed above with respect to the polyurethane prepolymer, e.g., polyether polyols, polycaprolactone polyols, polyester polyols, polycarbonate polyols, hydrocarbon polyols, other polyols, and mixtures thereof, are also suitable for blending with the polyether amine. The molecular weight of these polymers may be from about 200 to about 4000, but also may be from about 1000 to about 3000, and more preferably are from about 1500 to about 2500.

The polyurea composition can be formed by crosslinking the polyurea prepolymer with a single curing agent or a blend of curing agents. The curing agent of the invention is preferably an amine-terminated curing agent, more preferably a secondary diamine curing agent so that the composition contains only urea linkages. In one embodiment, the amine-terminated curing agent may have a molecular weight of about 64 or greater. In another embodiment, the molecular weight of the amine-curing agent is about 2000 or less. As discussed above, certain amine-terminated curing agents may be modified with a compatible amine-terminated freezing point depressing agent or mixture of compatible freezing point depressing agents.

Suitable amine-terminated curing agents include, but are not limited to, ethylene diamine; hexamethylene diamine; 1-methyl-2,6-cyclohexyl diamine; tetrahydroxypropylene ethylene diamine; 2,2,4- and 2,4,4-trimethyl-1,6-hexanediamine; 4,4'-bis-(sec-butylamino)-dicyclohexylmethane; 1,4-bis-(sec-butylamino)-cyclohexane; 1,2-bis-(sec-butylamino)-cyclohexane; derivatives of 4,4'-bis-(sec-butylamino)-dicyclohexylmethane; 4,4'-dicyclohexylmethane diamine; 1,4-cyclohexane-bis-(methylamine); 1,3-cyclohexane-bis-(methylamine); diethylene glycol di-(aminopropyl)ether; 2-methylpentamethylene-diamine; diaminocyclohexane; diethylene triamine; triethylene tetramine; tetraethylene pentamine; propylene diamine; 1,3-diaminopropane; dimethylamino propylamine; diethylamino propylamine; dipropylene triamine; imido-bis-propylamine; monoethanolamine, diethanolamine; triethanolamine; monoisopropanolamine, diisopropanolamine; isophoronediamine; 4,4'-methylenebis-(2-chloroaniline); 3,5; dimethylthio-2,4-toluenediamine; 3,5-dimethylthio-2,6-toluenediamine; 3,5-diethylthio-2,4-toluenediamine; 3,5; diethylthio-2,6-toluenediamine; 4,4'-bis-(sec-butylamino)-diphenylmethane and derivatives thereof; 1,4-bis-(sec-butylamino)-benzene; 1,2-bis-(sec-butylamino)-benzene; N,N'-dialkylamino-diphenylmethane; N,N,N',N'-tetrakis(2-hydroxypropyl)ethylene diamine; trimethyleneglycol-di-p-aminobenzoate; polytetramethyleneoxide-di-p-aminobenzoate; 4,4'-methylenebis-(3-chloro-2,6-diethyleneaniline); 4,4'-methylenebis-(2,6-diethylaniline); meta-phenylenediamine; paraphenylenediamine; and mixtures thereof. In one embodiment, the amine-terminated curing agent is 4,4'-bis-(sec-butylamino)-dicyclohexylmethane.

Suitable saturated amine-terminated curing agents include, but are not limited to, ethylene diamine; hexamethylene diamine; 1-methyl-2,6-cyclohexyl diamine; tetrahydroxypropylene ethylene diamine; 2,2,4- and 2,4,4-trimethyl-1,6-hexanediamine; 4,4'-bis-(sec-butylamino)-dicyclohexylmethane; 1,4-bis-(sec-butylamino)-cyclohexane; 1,2-bis-(sec-butylamino)-cyclohexane; derivatives of 4,4'-bis-(sec-butylamino)-dicyclohexylmethane; 4,4'-dicyclohexylmethane diamine; 4,4'-methylenebis-(2,6-diethylaminocyclohexane; 1,4-cyclohexane-bis-(methylamine); 1,3-cyclohexane-bis-(methylamine); diethylene glycol di-(aminopropyl)ether; 2-methylpentamethylene-diamine; diaminocyclohexane; diethylene triamine; triethylene tetramine; tetraethylene pentamine; propylene diamine; 1,3-diaminopropane; dimethylamino propylamine; diethylamino propylamine; imido-bis-propylamine; monoethanolamine, diethanolamine; triethanolamine; monoisopropanolamine, diisopropanolamine; isophoronediamine; triisopropanolamine; and mixtures thereof. In addition, any of the polyether amines listed above may be used as curing agents to react with the polyurea prepolymers.

Cover layers of the inventive golf ball may also be formed from ionomeric polymers, preferably highly-neutralized ionomers (HNP). In a preferred embodiment, at least one intermediate layer of the golf ball is formed from an HNP material or a blend of HNP materials. The acid moieties of the HNP's, typically ethylene-based ionomers, are preferably neutralized greater than about 70%, more preferably greater than about 90%, and most preferably at least about 100%. The HNP's can be also be blended with a second polymer component, which, if containing an acid group, may be neutralized in a conventional manner, by the organic fatty acids of the present invention, or both. The second polymer component, which may be partially or fully neutralized, preferably comprises ionomeric copolymers and terpolymers, ionomer precursors, thermoplastics, polyamides, polycarbonates, polyesters, polyurethanes, polyureas, thermoplastic elastomers, polybutadiene rubber, balata, metallocene-catalyzed polymers (grafted and non-grafted), single-site polymers, high-crystalline acid polymers, cationic ionomers, and the like. HNP polymers typically have a material hardness of between about 20 and about 80 Shore D, and a flexural modulus of between about 3,000 psi and about 200,000 psi.

In one embodiment of the present invention the HNP's are ionomers and/or their acid precursors that are preferably neutralized, either filly or partially, with organic acid copolymers or the salts thereof. The acid copolymers are preferably α-olefin, such as ethylene, $C_{3-8}$ α,β-ethylenically unsaturated carboxylic acid, such as acrylic and methacrylic acid, copolymers. They may optionally contain a softening monomer, such as alkyl acrylate and alkyl methacrylate, wherein the alkyl groups have from 1 to 8 carbon atoms.

The acid copolymers can be described as E/X/Y copolymers where E is ethylene, X is an α,β-ethylenically unsaturated carboxylic acid, and Y is a softening comonomer. In a preferred embodiment, X is acrylic or methacrylic acid and Y is a $C_{1-8}$ alkyl acrylate or methacrylate ester. X is preferably present in an amount from about 1 to about 35 weight percent of the polymer, more preferably from about 5 to about 30 weight percent of the polymer, and most preferably from about 10 to about 20 weight percent of the polymer. Y is preferably present in an amount from about 0 to about 50 weight percent of the polymer, more preferably from about 5 to about 25 weight percent of the polymer, and most preferably from about 10 to about 20 weight percent of the polymer.

Specific acid-containing ethylene copolymers include, but are not limited to, ethylene/acrylic acid/n-butyl acrylate, ethylene/methacrylic acid/n-butyl acrylate, ethylene/methacrylic acid/iso-butyl acrylate, ethylene/acrylic acid/iso-butyl acrylate, ethylene/methacrylic acid/n-butyl methacrylate, ethylene/acrylic acid/methyl methacrylate, ethylene/acrylic acid/methyl acrylate, ethylene/methacrylic acid/methyl acrylate, ethylene/methacrylic acid/methyl methacrylate, and ethylene/acrylic acid/n-butyl methacrylate. Preferred acid-containing ethylene copolymers include, ethylene/methacrylic acid/n-butyl acrylate, ethylene/acrylic acid/n-butyl acrylate, ethylene/methacrylic acid/methyl acrylate, ethylene/acrylic acid/ethyl acrylate, ethylene/methacrylic acid/ethyl acrylate, and ethylene/acrylic acid/methyl acrylate copolymers. The most preferred acid-containing ethylene copolymers are, ethylene/(meth) acrylic acid/n-butyl, acrylate, ethylene/(meth)acrylic acid/ethyl acrylate, and ethylene/(meth) acrylic acid/methyl acrylate copolymers.

Ionomers are typically neutralized with a metal cation, such as Li, Na, Mg, K, Ca, or Zn. It has been found that by adding sufficient organic acid or salt of organic acid, along with a suitable base, to the acid copolymer or ionomer, however, the ionomer can be neutralized, without losing processability, to a level much greater than for a metal cation. Preferably, the acid moieties are neutralized greater than about 80%, preferably from 90-100%, most preferably 100% without losing processability. This accomplished by melt-blending an ethylene α,β-ethylenically unsaturated carboxylic acid copolymer, for example, with an organic acid or a salt of organic acid, and adding a sufficient amount of a cation source to increase the level of neutralization of all the acid moieties (including those in the acid copolymer and in the organic acid) to greater than 90%, (preferably greater than 100%).

The organic acids of the present invention are aliphatic, mono- or multi-functional (saturated, unsaturated, or multi-unsaturated) organic acids. Salts of these organic acids may also be employed. The salts of organic acids of the present invention include the salts of barium, lithium, sodium, zinc, bismuth, chromium, cobalt, copper, potassium, strontium, titanium, tungsten, magnesium, cesium, iron, nickel, silver, aluminum, tin, or calcium, salts of fatty acids, particularly stearic, behenic, erucic, oleic, linoelic or dimerized derivatives thereof. It is preferred that the organic acids and salts of the present invention be relatively non-migratory (they do not bloom to the surface of the polymer under ambient temperatures) and non-volatile (they do not volatilize at temperatures required for melt-blending).

The ionomers of the invention may also be more conventional ionomers, i.e., partially-neutralized with metal cations. The acid moiety in the acid copolymer is neutralized about 1 to about 90%, preferably at least about 20 to about 75%, and more preferably at least about 40 to about 70%, to form an ionomer, by a cation such as lithium, sodium, potassium, magnesium, calcium, barium, lead, tin, zinc, aluminum, or a mixture thereof.

A moisture vapor barrier layer, such as disclosed in U.S. Pat. Nos. 6,632,147; 6,932,720; 7,004,854; and 7,182,702, all of which are incorporated by reference herein in their entirety, are optionally employed between the cover layer and the core. The moisture barrier layer may be disposed between the outer core layer and the cover layer. The moisture vapor barrier protects the inner and outer cores from degradation due to exposure to moisture, for example water, and extends the usable life of the golf ball. The moisture vapor transmission rate of the moisture barrier layer is selected to be less than the moisture vapor transmission rate of the cover layer. The moisture barrier layer has a specific gravity of from about 1.1 to about 1.2 and a thickness of less than about 0.03 inches. Suitable materials for the moisture barrier layer include a combination of a styrene block copolymer and a flaked metal, for example aluminum flake.

Unless otherwise expressly specified, all of the numerical ranges, amounts, values and percentages such as those for amounts of materials, and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

While it is apparent that the illustrative embodiments of the invention disclosed herein fulfill the preferred embodiments of the present invention, it is appreciated that numerous modifications and other embodiments may be devised by those skilled in the art. Examples of such modifications include reasonable variations of the numerical values and/or materials and/or components discussed above. Hence, the numerical values stated above and claimed below specifically include those values and the values that are approximate to those stated and claimed values. Therefore, it will be understood that the appended claims are intended to cover all such modifications and embodiments, which would come within the spirit and scope of the present invention.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. For example, the compositions of the present invention may be used in a variety of equipment. Such modifications are also intended to fall within the scope of the appended claims.

While any of the embodiments herein may have any known dimple number and pattern, a preferred number of dimples is 252 to 456, and more preferably is 330 to 392. The dimples may comprise any width, depth, and edge angle disclosed in the prior art and the patterns may comprises multitudes of dimples having different widths, depths and edge angles. The parting line configuration of said pattern may be either a straight line or a staggered wave parting line (SWPL). Most preferably the dimple number is 330, 332, or 392 and comprises 5 to 7 dimples sizes and the parting line is a SWPL.

In any of these embodiments the single-layer core may be replaced with a 2 or more layer core wherein at least one core layer has a negative hardness gradient. Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range.

Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

While it is apparent that the illustrative embodiments of the invention disclosed herein fulfill the objective stated above, it is appreciated that numerous modifications and other embodiments may be devised by those skilled in the art. Therefore, it will be understood that the appended claims are intended to cover all such modifications and embodiments, which would come within the spirit and scope of the present invention.

What is claimed is:

1. A golf ball comprising:

a two layer core and a cover disposed about the two layer core, the two layer core comprising an inner core layer and an outer core layer disposed about the inner core layer, said inner core layer comprising a geometric center and a first outer surface and being formed from a substantially homogenous formulation and having a diameter of about 30 mm or lower and having a plurality of hardnesses of from about 60 Shore C to about 85 Shore C, the geometric center comprising a first hardness and the first outer surface comprising a second hardness wherein the second hardness is greater than the first hardness to define a positive hardness gradient of from about 5 Shore C to about 20 Shore C;

said outer core layer comprising an inner surface and a second outer surface and being formed from a substantially homogenous formulation and comprising a thickness of about 10 mm or lower and having a plurality of hardnesses of from about 60 Shore C to about 95 Shore C, wherein the inner surface comprises a third hardness that is similar to the second hardness and the second outer surface comprises a fourth hardness, the outer core layer further comprising a fifth hardness disposed between the inner surface and the second outer surface, wherein the fifth hardness is greater than the third hardness and the fourth hardness, and the plurality of hardnesses of the outer core layer beyond the third hardness is greater than the plurality of hardnesses of the inner core layer; and wherein the fourth hardness is greater than the first hardness to define a positive hardness gradient of about 30 Shore C or lower.

2. The golf ball of claim 1, wherein the fifth hardness is disposed between the inner surface and the second outer surface in a region extending between about 10% and about 90% of the distance from the inner surface to the second outer surface.

3. The golf ball of claim 1, wherein the fifth hardness is disposed between the inner surface and the second outer surface in a region extending radially from about 13 mm to about 20 mm from the geometric center.

4. The golf ball of claim 1, wherein the fourth hardness is greater than the third hardness to define a positive hardness gradient of about 20 Shore C or lower.

5. The golf ball of claim 4, wherein the fourth hardness is greater than the third hardness to define a positive hardness gradient of about 10 Shore C or lower.

6. The golf ball of claim 1, wherein the fourth hardness is greater than the first hardness to define a positive hardness gradient of about 25 Shore C or lower.

* * * * *